US006798427B1

(12) United States Patent
Suzuki et al.

(10) Patent No.: US 6,798,427 B1
(45) Date of Patent: Sep. 28, 2004

(54) APPARATUS FOR AND METHOD OF INPUTTING A STYLE OF RENDITION

(75) Inventors: Hideo Suzuki, Hamamatsu (JP); Masao Sakama, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/489,431

(22) Filed: Jan. 21, 2000

(30) Foreign Application Priority Data

Jan. 28, 1999 (JP) ..... 11-020850
Jan. 28, 1999 (JP) ..... 11-020851
Jan. 28, 1999 (JP) ..... 11-020852

(51) Int. Cl.[7] ..... G09G 5/00
(52) U.S. Cl. ..... 345/763; 84/662
(58) Field of Search ..... 345/727, 728, 345/762, 763, 626, 662, 637, 615; 84/26, 662, 637, 615, 653, 600, 609, 610, 626, 634, 635

(56) References Cited

U.S. PATENT DOCUMENTS 4,885,969 A 12/1989 Chesters ..... 84/615
5,146,833 A * 9/1992 Lui ..... 84/462
5,153,829 A 10/1992 Furuya et al. ..... 84/622
5,254,803 A * 10/1993 Terao ..... 524/503
5,646,362 A * 7/1997 Koyama et al. ..... 84/615
5,831,195 A * 11/1998 Nakata ..... 84/609
5,908,997 A * 6/1999 Arnold et al. ..... 84/615
6,121,529 A * 9/2000 Nakata et al. ..... 84/477 R

FOREIGN PATENT DOCUMENTS

EP 0632427 1/1995
WO WO 90/03629 4/1990

OTHER PUBLICATIONS

European Search Report—Application No. EP 00 10 1209 dated May 30, 2000.

* cited by examiner

*Primary Examiner*—John Cabeca
*Assistant Examiner*—Tadesse Hailu
(74) *Attorney, Agent, or Firm*—Morrison & Foerster LLP

(57) ABSTRACT

Score of a given music piece is visually shown on a display. When a particular style of rendition is to be imparted to a desired note on the musical score, a user selects a desired one of style-of-rendition icons and designates a desired note location on the musical score as a pasting location of the selected style-of-rendition icon. Thus, the selected style-of-rendition icon is shown on the display in corresponding relation to the designated pasting location. The style-of-rendition icons are appropriately associated with sets of style-of-rendition parameters, so that performance data, i.e., tonal characteristics of the note, corresponding to the pasted location of the style-of-rendition icon is controlled, in accordance with the style-of-rendition parameters corresponding to the pasted style-of-rendition icon on the musical score, to thereby achieve a performance in the style of rendition corresponding to the pasted icon. On the display screen, at least one-row of style-of-rendition display areas are set in parallel relation to a musical score display area, and the pasted style-of-rendition icon is shown any one of the style-of-rendition display areas. Further, on the display screen, the style-of-rendition icon pasted to the desired note location is designated for editing of corresponding style-of-rendition information.

62 Claims, 16 Drawing Sheets

| INSTRUMENT / STATE | SAXPHONE (Sax) | GUITAR (Guitr) | BASS | VIOLIN (Violn) |
|---|---|---|---|---|
| ALL | CRESCENDO<br>DECRESCENDO | CRESCENDO<br>DECRESCENDO | CRESCENDO<br>DECRESCENDO | CRESCENDO<br>DECRESCENDO |
| ATTACK<br>(Atack) | NORMAL (DEFAULT)<br>BEND-UP<br>GRACE-UP (DOWN)<br>CHROMATIC-UP (DOWN)<br>GLISS<br>STACCATO | NORMAL (DEFAULT)<br>CHOKING-UP<br>(=BEND-UP) | NORMAL (DEFAULT)<br>CHOKING-UP<br>(=BEND-UP) | NORMAL (DEFAULT)<br>DÉTACHÉ<br>STACCATO |
| BODY | NORMAL (DEFAULT)<br>VIBRATO<br>BEND-UPDOWN | NORMAL (DEFAULT)<br>VIBRATO | NORMAL (DEFAULT)<br>VIBRATO | NORMAL (DEFAULT)<br>VIBRATO |
| RELEASE<br>(Reles) | NORMAL (DEFAULT)<br>SHORTCUT<br>BEND<br>CHROMATIC-UP (DOWN)<br>GLISS | NORMAL (DEFAULT)<br>GLISS-UP (DOWN)<br>MUTE | NORMAL (DEFAULT)<br>GLISS-UP (DOWN)<br>MUTE | NORMAL (DEFAULT) |
| JOINT | TENUTO<br>SLUR | HAMMER-ON<br>PULL-OFF<br>SLIDE-UP (DOWN) | HAMMER-ON<br>PULL-OFF<br>SLIDE-UP (DOWN) | TENUTO<br>SLUR |

FIG. 12

APPARATUS FOR AND METHOD OF INPUTTING A STYLE OF RENDITION

BACKGROUND OF THE INVENTION

The present invention relates generally to style-of-rendition inputting apparatus and methods, and more particularly to an interactive style-of-rendition inputting apparatus and method for entering articulation original music-piece note data by use of icons visually shown on a display screen.

In actually playing a musical instrument, there are employed a variety of styles of rendition, such as "bend-up" to raise a pitch of an original tone, "grace" to decorate an original tone, "vibrato" to vibrate tone and "legato" to smoothly connect successive tones. To realize these styles of rendition, it has been conventional to sequentially write articulation data, indicative of such styles of rendition, into white data (e.g., in the MIDI format) on a style-by-style basis using fine time units. Although the conventional approach would require an enormous amount of time and labor, it can not efficiently synthesize realistic high-quality articulation with efficiency.

SUMMARY OF THE INVENTION

In view of the foregoing, it is an object of the present invention to provide a style-of-rendition inputting apparatus and method which, in order to give music performance data a high-quality performance expression (i.e., articulation) just as achieved by a corresponding acoustic musical instrument, can input style-of-rendition information corresponding to a desired articulation style with utmost ease.

It is another object of the present invention to provide a style-of-rendition inputting apparatus and method which propose use of style-of-rendition icons to allow any desired articulation to be imparted with utmost ease and also can effectively display such style-of-rendition icons.

It is still another object of the present invention to provide a style-of-rendition inputting apparatus and method which can readily perform control to modify any selected articulation.

In order to accomplish the above-mentioned objects, the present invention provides a style-of-rendition inputting apparatus which comprises: a display; an operator device; and a processor coupled with the display and the operator device. The processor is adapted to: show a musical score of a given music piece on the display; select a desired style-of-rendition icon in response to an operation of the operator device and designate a desired icon pasting location on the musical score; and show the selected style-of-rendition icon on the display in corresponding relation to the designated icon pasting location.

According to the present invention, by selecting a style-of-rendition icon corresponding to a desired articulation style and pasting the selected style-of-rendition icon to a desired location on the musical score visually shown on the display, it is possible to input or enter desired style-of-rendition information in corresponding relation to a music performance progression position that corresponds to the pasted location of the selected style-of-rendition icon. This inventive arrangement allows the user to know very easily what kind of style-of-rendition information should be entered in which location of the progressing music performance, so that the user's entry of the style-of-rendition information can be made in a very simplified manner. Thus, a high-quality performance expression (i.e., articulation), just as achieved by a corresponding acoustic musical instrument, can be easily imparted to music performance data. Of various articulation styles achievable by acoustic musical instruments, some can be appropriately expressed by the traditional or existing music notations and some can't. The respective figures (including sizes) of the style-of-rendition icons may be chosen as desired. For instance, the style-of-rendition icons corresponding to articulation styles that can be expressed by the traditional or existing music notations may be chosen to be identical or analogous in figure to the traditional or existing music notations. On the other hand, those style-of-rendition icons corresponding to articulation styles that can not be expressed by the existing music notations may be represented by any suitable figures which could allow the user to readily image the articulation in question.

In the present invention, it is preferable that the musical score of the music piece be displayed in the most popular "staff" notation which is very easy for every user to utilize; however, the musical score may be displayed in any other suitable notation than the "staff" notation as long as the notation used can appropriately show a note or performance progression of the music piece. For example, a combination of pictorial representation of notes and literal representation of note names, a combination of literal representation of note lengths and pictorial representation of notes, or a combination of bar graph representation of note lengths and other corresponding note representation may be visually displayed in a time series. Namely, in the present invention, the "musical score" may be in any other suitable notation than the "staff" notation as long as the notation used can appropriately show a note or performance progression of the music piece.

The processor is further adapted to impart style-of-rendition parameters, corresponding to each style-of-rendition icon pasted on the musical score, to original performance data corresponding to the musical score, and thus the use of the style-of-rendition parameters allows a music performance to be executed in a style of rendition corresponding to the pasted style-of-rendition icon. Namely, the style-of-rendition icons are appropriately associated with sets of the style-of-rendition parameters, so that performance data, i.e., tonal characteristics of a note, corresponding to the pasted location of each style-of-rendition icon is set or controlled, in accordance with the style-of-rendition parameters corresponding to the pasted style-of-rendition icon on the musical score, to thereby achieve a performance in the style of rendition corresponding to the pasted icon. The style-of-rendition parameters may be time-serial tone parameters obtained by analyzing a waveform of an actual performance tone of a musical instrument. The time-serial tone parameters contain a plurality of musical factors, such as a waveform factor unique to the style of rendition used for the instrument's tone color, a pitch factor, an amplitude factor, and a tone color (timbre) control factor.

In order to place a desired style-of-rendition icon in a selectable condition in response to an operation of the operator device, the processor may be further adapted to accept selection of a musical instrument and show, on the display, a set of available style-of-rendition icons for the selected musical instrument, so that the user is allowed to select a desired one of the available style-of-rendition icons visually shown on the display. In this manner, it is possible to readily select a style-of-rendition icon suited for the selected musical instrument (or tone color).

In imparting various articulation to the original music-piece note data, the present invention can synthesize any desired articulation with high quality and enhanced efficiency through very simple operations of pre-registering various articulation styles in the form of icons and pasting the pre-registered icons on a musical score of the original music-piece note data visually shown on the display.

With the arrangement that one style-of-rendition icon is shared, for identical or similar articulation, among a plurality of musical instruments, the present invention can substantially facilitate the user operation of the style-of-rendition icons to enter and set the articulation to the original music-piece note data and thereby achieves an improved operating efficiency. Further, even when a style-of-rendition icon shared among a plurality of musical instruments is pasted, the present invention can impart articulation, unique to each of the sharing musical instruments of individual parts, to the original music-piece note data in an actual performance, so that high-quality performance expression is achieved by the present invention.

Furthermore, because the performance data corresponding to each pasted style-of-rendition icon are stored in memory using data identifying the icon, i.e., a unique icon number, the necessary procedures for storing the performance data can be significantly simplified. In addition, because only the style-of-rendition icons representative of applicable articulation data are visually displayed in correspondence with the musical instrument of the part to which it is to be pasted—without any other icons than the style-of-rendition icons to be used for the musical instrument being displayed at all—, it is possible to efficiently impart articulation suited for the musical instrument to be played.

A style-of-rendition inputting apparatus according to another aspect of the present invention comprises a display, an operator device, and a processor coupled with the display and the operator device, where the processor is adapted to: show a musical score of a given music piece on the display; set at least one row of style-of-rendition display areas in parallel relation to a musical score display area on the display; select a desired style-of-rendition icon in response to an operation of the operator device and designate a desired icon pasting location on the musical score; and show the selected style-of-rendition icon in the style-of-rendition display area on the display in corresponding relation to the designated icon pasting location. With such arrangements, the present invention can effectively display the style-of-rendition icon pasted to each desired performance progression location of an original music piece. The processor may be adapted to set a plurality rows of the style-of-rendition display areas in parallel relation to the musical score display area on the display, so that when a plurality of different style-of-rendition icons are to be pasted to a same location on the musical score, the style-of-rendition icons can be shown in the respective style-of-rendition display areas. Thus, the present invention greatly facilitates pasting of two or more style-of-rendition icons onto one and the same location of the musical score, thereby effectively facilitating control to impart high-quality articulation. The above-mentioned "plurality rows of the style-of-rendition display areas" are also referred to simply as "layers" in the later-described preferred embodiment.

Because a plurality of the layers are provided on the display in parallel relation to the original music-piece data display area, the style-of-rendition icons are classified in advance into groups representative of similar articulation styles (styles of rendition) and specific similar style-of-rendition icons are pasted to and displayed in each of the layers, in response to a user selection of any one of the style-of-rendition icons on the basis of the classification, the present invention allows the user to readily identify the current articulation settings.

Further, with the arrangements that the original music-piece data display area and icon pasting areas are provided on the displayed screen and such articulation styles capable of being expressed by the traditional music notations are displayed along with the original music-piece data in the original music-piece data display area while articulation styles unique to the musical instrument to be performed are displayed as style-of-rendition icons in the icon pasting areas, the present invention allows the user to readily identify and ascertain each articulation style being currently set.

A style-of-rendition inputting apparatus in accordance with still another aspect of the present invention comprises a display, an operator device, and a processor coupled with the display and the operator device, where the processor is adapted to: show a musical score of a given music piece on the display; cause a given style-of-rendition icon to be pasted to and shown at a given performance location on the musical score shown on the display; and use the operator device to designate the style-of-rendition icon pasted to the given performance location on the musical score, to edit style-of-rendition information corresponding to the designated style-of-rendition icon. With such arrangements, the present invention can easily perform control to modify any selected articulation. In this invention, the processor may edit the style-of-rendition information by modifying the figure (including the size) of the style-of-rendition icon pasted on the musical score visually shown on the display.

According to the present invention, each of the style-of-rendition icons can be modified in its figure (including the size) typically in either or both of the horizontal and vertical directions. Specifically, the articulation data may be adjusted in the time-axial direction by the horizontal modification of the style-of-rendition icon, the effectiveness or depth of the articulation data may be adjusted by the vertical modification of the style-of-rendition icon, or the time-axial and depth adjustments may be made by simultaneously effecting the horizontal and vertical modifications of the style-of-rendition icon.

Further, according to the present invention, the degree of each articulation to be imparted to the original music piece data can be controlled finely and as desired by modifying the figure of the style-of-rendition icon having been pasted to the original music piece data on the display screen, with the result that high-quality articulation can be provided with increased efficiency. Normally, a plurality of style-of-rendition icons are displayed as "candidate" icons for each type of articulation so that the user can select a desired one of the displayed style-of-rendition icons. In case articulation of a desired degree can not be obtained, interpolation can be readily made between the respective sizes of the candidate icons through the style-of-rendition icon modification scheme of the present invention.

The style-of-rendition icon modification can be made in a very simple manner by, as noted above, modifying the figure of the style-of-rendition icon in question in either or both of the horizontal and vertical directions. The articulation data, i.e., style-of-rendition parameters, can be adjusted in the time-axial direction by the horizontal modification of the style-of-rendition icon, the effectiveness or depth of the articulation data (i.e., style-of-rendition parameters) can be adjusted by the vertical modification of the style-of-rendition icon, and these time-axial and depth adjustments can be made by simultaneously effecting the horizontal and vertical modifications of the style-of-rendition icon. Thus, the present invention can effectively control articulation characteristics through the icon modification.

The present invention may be constructed and implemented not only as the above-mentioned apparatus invention but also as a method invention. The method may be arranged and implemented as a program for execution by a computer, microprocessor or the like, as well as a machine-readable storage medium storing such a program. Further, the hardware implementing the present invention may comprise a combination of logic circuitry and gate array or a functionally-fixed hardware device including an integrated circuit, without being necessarily limited to a programmable facility such as a computer or microprocessor. Stated differently, the processor in the present invention may be a non-programable processor or control unit only having fixed processing functions, not to mention a programmable processor such as a computer or microprocessor. Further, the style-of-rendition inputting apparatus or electronic music apparatus embodying the present invention may be of any other type than an electronic musical instrument, such as an automatic performance sequencer, automatic music composing apparatus or a personal computer so programmed as to be capable of music performance. Moreover, the style-of-rendition inputting apparatus or electronic music apparatus of the present invention may be a karaoke apparatus, game apparatus, cellular phone or any other type of multimedia equipment. Further, the electronic musical instrument of the present invention may be of any other type than the keyboard-based instrument.

BRIEF DESCRIPTION OF THE DRAWINGS

For better understanding of the object and other features of the present invention, its preferred embodiments will be described in greater detail hereinbelow with reference to the accompanying drawings, in which:

FIG. 12 is a diagram showing an exemplary listing of the style-of-rendition icons provided for individual musical instruments in the style-of-rendition inputting apparatus of FIG. 1;

DETAILED DESCRIPTION OF THE PREFERRED EMBODIMENTS

[Hardware Setup]

Figure 1:
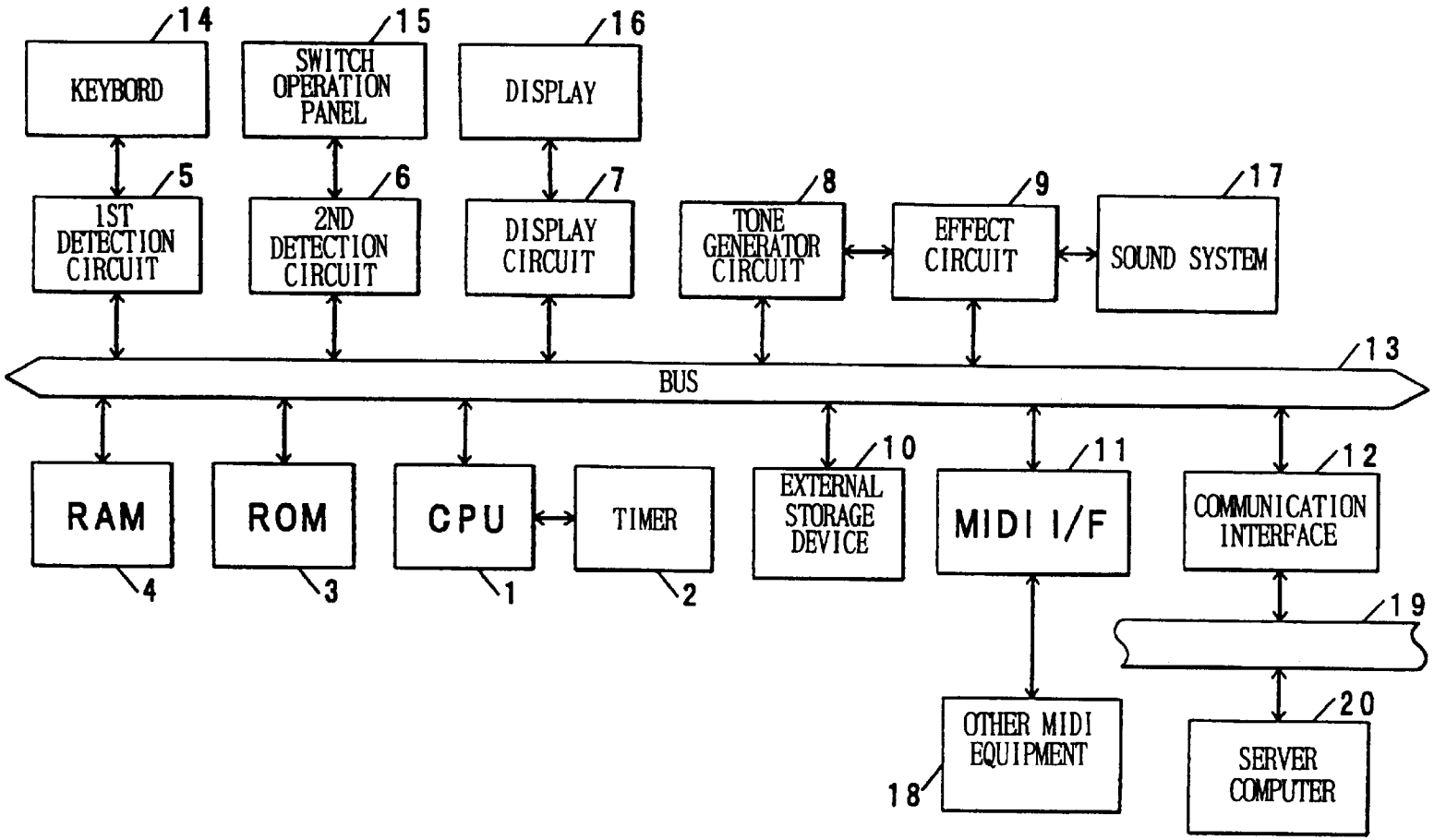
FIG. 1 is a hardware block diagram of a style-of-rendition inputting apparatus in accordance with a preferred embodiment of the present invention.

Referring first to FIG. 1, there is shown a hardware block diagram of a style-of-rendition inputting apparatus in accordance with a preferred embodiment of the present invention. In FIG. 1, the style-of-rendition inputting apparatus includes a CPU (Central Processing Unit) 1, a timer 2, a read-only memory (ROM) 3, a random access memory (RAM) 4, a first detection circuit 5, a second detection circuit 6, a display circuit 7, a tone generator (T.G.) circuit 8, an effect circuit 9, an external storage device 10, a MIDI (Musical Instrument Digital Interface) interface 11, a communication interface 12, etc. which are connected with each other via a bus 13.

The CPU 1, which controls operation of the entire apparatus, is connected with the timer 2 that generates tempo clock pulses to be used in various interrupt processes. In accordance with predetermined programs, the CPU 1 carries out various control and particularly performs a function of generating music piece data as will be described later in detail. In the ROM 3, there are prestored predetermined control programs for controlling the style-of-rendition inputting apparatus, which may include various processing programs and data pertaining to entry of articulation as well as a fundamental performance information processing program. The RAM 4 is used for temporarily storing various data and parameters necessary for the processing and used as various registers, flags and working areas for temporarily storing various data being processed.

Keyboard 14 and switch operation panel 15 are connected to the first and second detection circuits 5 and 6, respectively. Display 16 is connected to the display circuit 7, and a sound system 17 including a speaker and amplifier is connected to an effect circuit 9 so as to audibly reproduce tones based on performance data output from the tone generator circuit 8. The switch operation panel 15 includes, in addition to various switches for actual performance operation, various input switches necessary for operation and processing of the inventive style-of-rendition inputting apparatus so as to allow a user to enter various instructions, selections and data to the style-of-rendition parameters.

The external storage device 10 may comprise one or more of various conventional storage facilities, such as a hard disk device (HDD), floppy disk drive (FDD), compactdisk read-only-memory (CD-ROM) drive, magneto optical (MO) disk drive, digital versatile disk (DVD) drive, etc., as necessary. Each storage medium employed in the external storage device 10 can store therein, in the MIDI format, original note data of various music pieces and articulation-imparted music piece data.

The style-of-rendition inputting apparatus thus constructed of the above-mentioned components 1–17 may take the form of or be implemented as an electronic musical instrument, or application software plus a personal computer. Such application software may be stored in a medium installed in the external storage device 10, such as a magnetic disk, optical disk or a semiconductor memory, and may be supplied from the medium to the personal computer, or may be supplied from the outside via a communication network. Further, the style-of-rendition inputting apparatus is also applicable to music-piece-data making equipment, etc. for use in a karaoke device. Furthermore, the inventive style-of-rendition inputting apparatus may be applied to an automatically-played piano.

In the case where the inventive style-of-rendition inputting apparatus is implemented as an electronic musical instrument, it may be other than the keyboard type instrument as shown in FIG. 1, such as a stringed, wind or percussion type instrument. Furthermore, a tone generator device, automatic performance device and the like need not necessary be provided together within the electronic musical instrument; in some cases, these components may be provided separately and connected with each other via communication facilities such as the MIDI interface and communication network.

Also, according to the style-of-rendition inputting apparatus of the present invention, the MIDI interface (MIDI I/F) 11 and communication interface 12 are connected to the bus 13 so that MIDI performance data and the like can be communicated with other MIDI equipment 18. The inventive style-of-rendition inputting apparatus can also communicate with a desired server computer 20 via a communication network 19. The MIDI interface may be a general-purpose interface, rather than a dedicated MIDI interface, such as an RS-232C, universal serial bus (USB) or IEEE1394 interface. In such a case, other data than MIDI messages may also be communicated together with the MIDI messages.

[Outline of Articulation Setting and Performance Data Generation]

Figure 2:
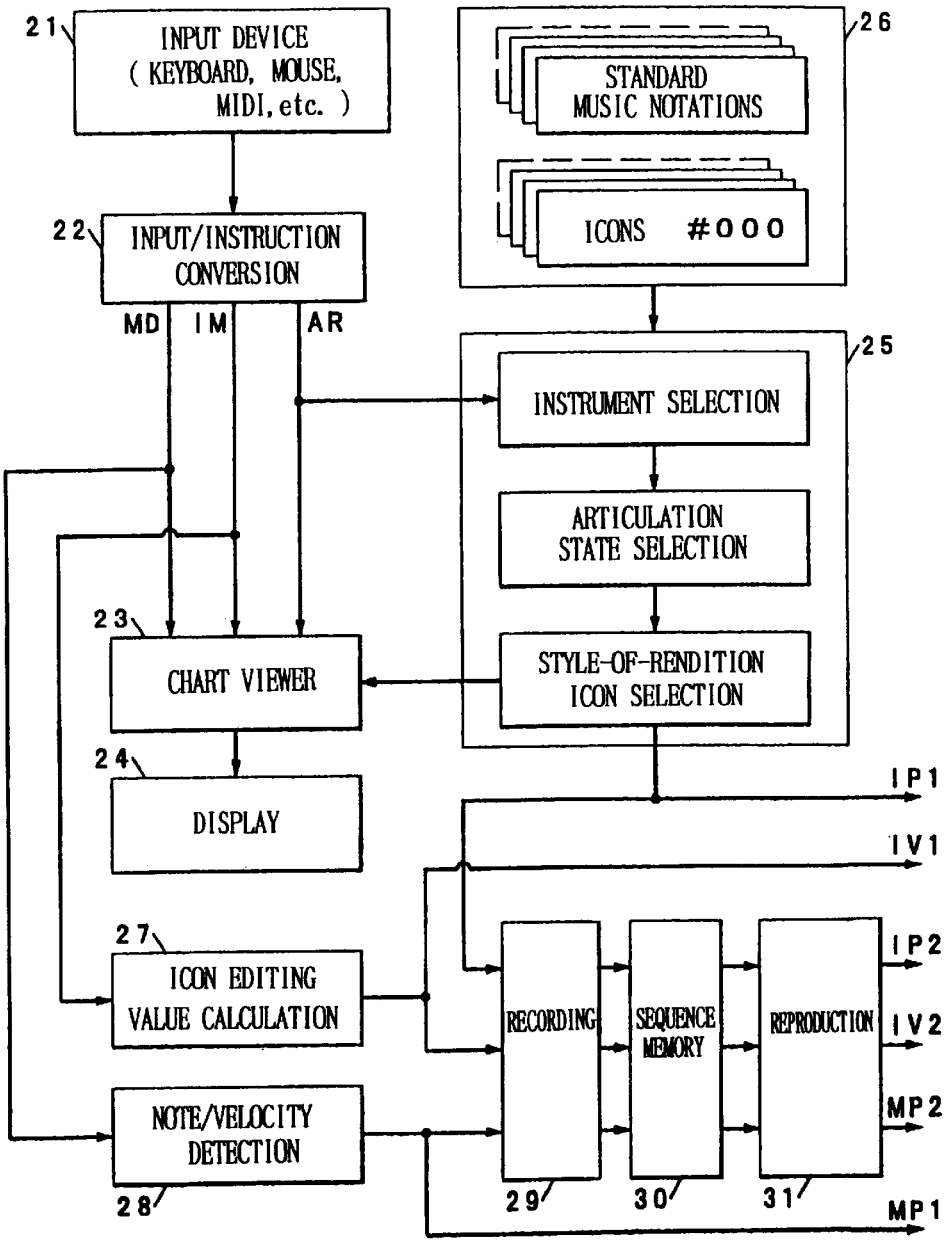
FIG. 2 is a part of a functional block diagram of the style-of-rendition inputting apparatus in accordance with the preferred embodiment of FIG. 1.
Figure 3:
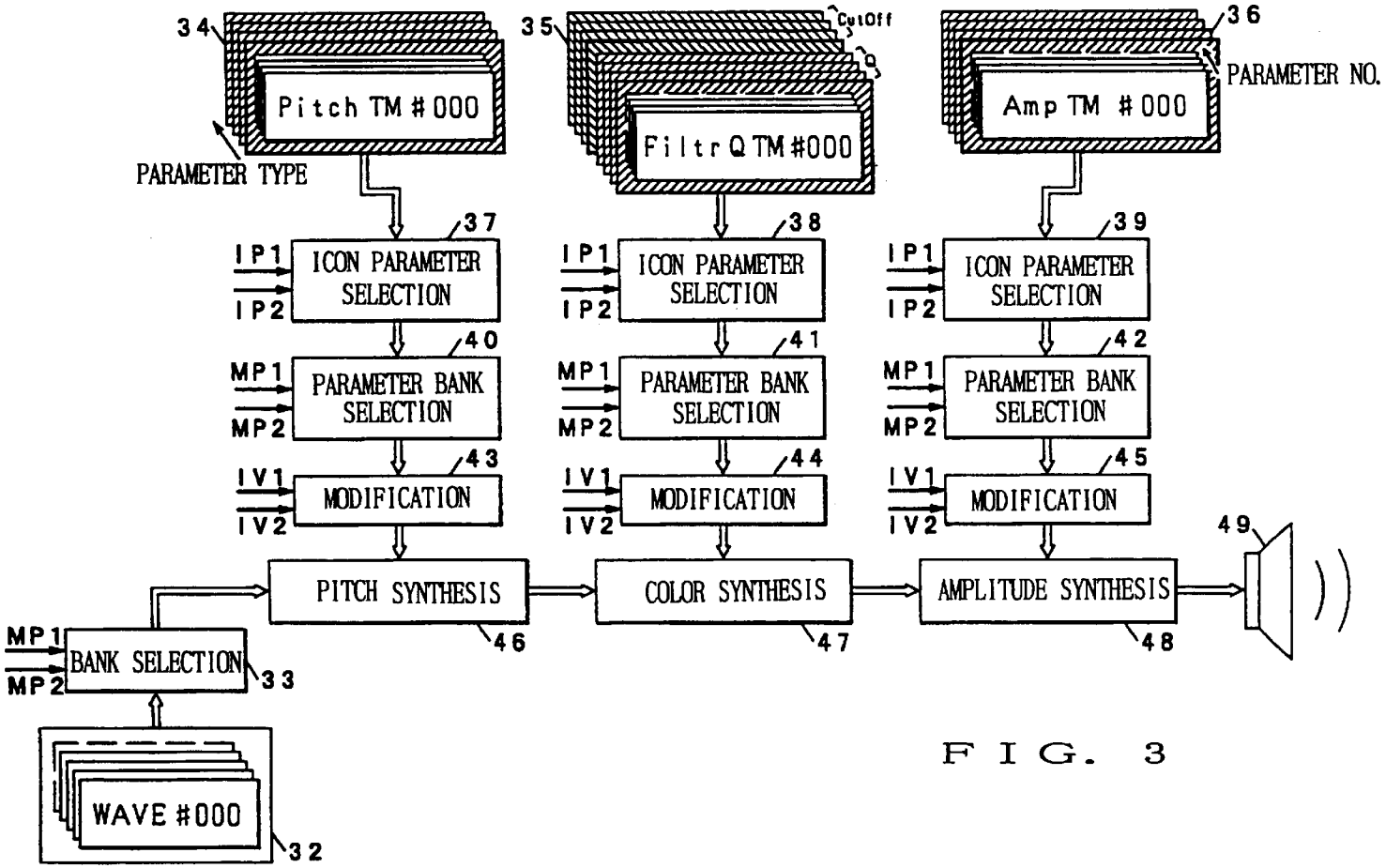
FIG. 3 is the remaining part of the functional block diagram of the style-of-rendition inputting apparatus of FIG. 1.

In FIGS. 2 and 3, there are shown functional block diagrams schematically showing exemplary schemes by which the style-of-rendition inputting apparatus in accordance with the preferred embodiment sets articulation and generates performance data; specifically, the blocks of FIG. 2 mainly constitute a data input section while the blocks of FIG. 3 mainly constitute a tone generator (T.G.) section. Describing the articulation-setting and performance-data-generating schemes with reference to these functional block diagrams, the data input section 21 comprises the external storage device 10, MIDI interface 11, keyboard 14, switch operation panel 15, etc., to which are supplied original music-piece note data (i.e., white data) mainly from the keyboard, MIDI equipment and/or the like. These supplied original music-piece note data are visually shown on the display 6 as a musical score (chart). The musical score of the original music piece may be automatically extracted by execution of a musical score extraction program on the basis of performance data prepared in the MIDI or other suitable format. Alternatively, musical score information in the form of image information may be received from a memory or from an external source and then visually shown on the display. In such a case, the performance data in the MIDI or other suitable format, corresponding to the musical score, may either be input separately or created by analyzing the image of the musical score. Desired articulation style can be instructed and put in the displayed musical score by manipulating a keyboard or mouse on the switch operation panel 15, and a style-of-rendition icon can be pasted onto the musical score by operating the style-of-rendition icon corresponding to the instructed articulation style.

Various data from the data input device 21 are decoded via an input/instruction conversion section 22, where they are broken down into original music-piece note data (white data) MD including data indicative of notes (pitches) and velocities (performance intensity), articulation instruction data AR including data indicative of a type of a selected musical instrument (such as saxophone or guitar), state (e.g., an attack or body state) and type or style (e.g., bend-up or grace-tone-up) of articulation, icon operation data IM to be added to the corresponding style-of-rendition icon. These data are used to visually show a picture of the musical score of the original music-piece note data (white data) and an articulation setting picture on the screen of a display (corresponding to the display 16 of FIG. 1) via a chart viewer 23.

The articulation instruction data AR is passed to an icon selection section 25, where a style-of-rendition icon (represented as "style icon" in some of the figures to save limited space) or standard music notation corresponding to the contents indicated by the instruction data AR is selected from among various icon numbers and music notations prestored in the RAM 4 or ROM 3. More specifically, to select the style-of-rendition icon, instrument-correspondent style-of-rendition icons that correspond to the instrument type is first selected from among a multiplicity of style-of-rendition icons, and then state-correspondent style-of-rendition icons are selected from among the selected instrument-correspondent style-of-rendition icons. Further, a particular style-of-rendition icon corresponding to a desired articulation style is selected from among the selected state-correspondent style-of-rendition icons. Such selected conditions and currently-selectable style-of-rendition icons are visually shown on the display via the chart viewer 23.

[Example 1 of Displayed Screen: Three-Layer Pasting]

Figure 4:
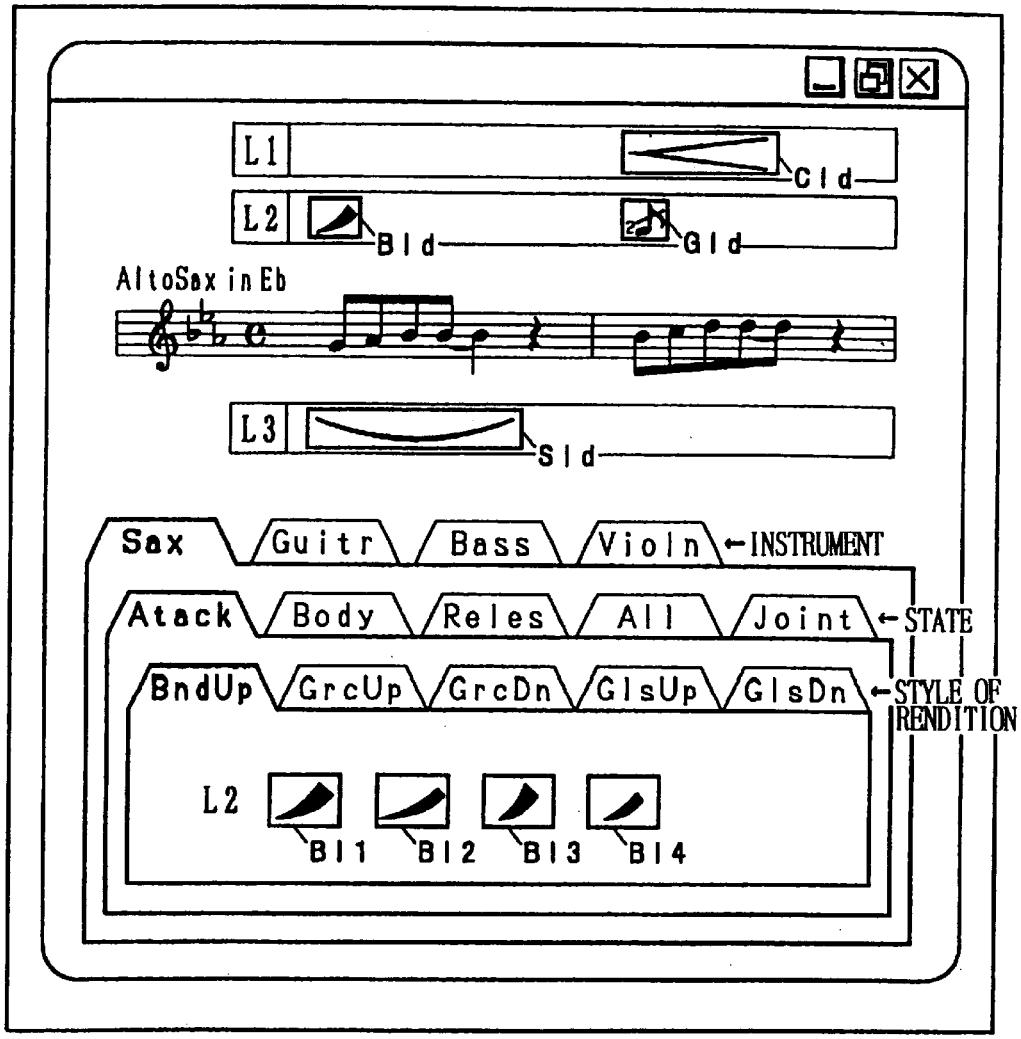
FIG. 4 is a diagram showing an example of a displayed screen in the apparatus of FIG. 1.

FIG. 4 is a diagram showing example 1 of displayed screen in the style-of-rendition inputting apparatus according to the preferred embodiment of the invention. Style-of-rendition icon windows are provided in a lower portion of the displayed screen, and a musical score corresponding to the original music-piece note data (white data) MD is shown in an upper portion of the displayed screen. Further, as display areas for showing style-of-rendition icons, first and second layers L1 and L2 are provided immediately above the musical score display area and a third layer L3 is provided immediately below the musical score display area. Thus, the display mode of FIG. 4 is called a "three-layer pasting" display mode. Examples of the style-of-rendition icons that can be pasted on these layers are as follows:

First Layer L1: crescendo and decrescendo;

Second Layer L2: bend-up, grace-tone-up/down, chromatic up/down, gliss-up/down, staccato, detache, vibrato, bend-downup, shortcut, mute and bend-down; and Third Layer L3: tenuto, slur, hammer-on, pull-off and slide-up According to example 1 of displayed screen as shown in FIG. 4, a "bend-up" icon BId is pasted on the second layer L2 with respect to a first or leading note in a first measure of the musical score data, and a "slur" icon SId is pasted on the third layer L3 to provide a smooth performance for the entire first measure. Further, for the second measure, a "grace note (two-tone-up)" icon GId is pasted on the second layer L2, and a "crescendo" icon CId is pasted on the first laser L1 to provide a gradual tone volume increase for the entire second measure.

Further, of the style-of-rendition icon windows in the lower half of the displayed screen, the outermost window includes tabs representing various types of musical instruments such as "saxophone (Sax)", "guitar (Guitr)", "bass" and "violin (Violn)", and any one of these musical instrument types can be selected by clicking on the corresponding tab. The displayed screen example of FIG. 4 shows that "saxophone" (abbreviated "Sax") is being currently selected. The middle or second window includes tabs representing various articulation states such as "attack (Atack) ", "body", "release (Reles)", "all" and "joint", and any one of these articulation states can be selected by clicking on the corresponding tab. The displayed screen example of FIG. 4 shows that the "attack" (Atack) state is being currently selected.

Further, the third or innermost window includes tabs representing various styles of rendition such as "bend-up (BndUp)", "grace-tone-up (GrcUp)", "grace-tone-down (GrcDn)", "glissando-up (GlsUp)" and "glissando-down (GlsDn)", and any one of the styles of rendition can be selected by clicking on the corresponding tab.

In each of the above-mentioned style-of-rendition windows, there are also visually shown a plurality of style-of-rendition-candidate icons each indicative of articulation having a predetermined depth (also called "value") and length (also called "speed" or "time"), and the vertical (top-bottom) and horizontal (left-right) dimensions of each of these style-of-rendition icons corresponds to the depth and length of the articulation. Thus, the user is allowed to impart articulation of a desired depth and length to the musical score by just selecting a suitable one of the style-of-rendition-candidate icons.

The displayed screen example of FIG. 4 shows that the "bend-up" (BndUp) style is being currently selected and that four bend-up-candidate icons BI1–BI4, indicative of "deep and slow", "shallow and slow", "deep and quick" and "shallow and quick" bend-up styles, following the layer number "L2", can be pasted on the second layer L2 as style-of-rendition icons.

In the case where saxophone ("Sax") has been selected as shown in FIG. 4 and when "deep and slow bend-up" is to be imparted to the leading note (G4) of the first measure of the musical score data in order to provide articulation AR to the original music-piece note data, the user first clicks on the "attack" ("Atack") state and then clicks on the "bend-up" ("BndUp") style of rendition. Thus, the four bend-up-candidate icons BI1–BI4 are shown in the innermost style-of-rendition icon window. Then, as the user manipulates the mouse to drag and drop the leftmost "deep and slow" bend-up-candidate icon BI1 at the location of the leading note (G4) in the first measure of the musical score data, a "deep and slow" bend-up icon BId is pasted to a location of the second layer L2 corresponding to the leading note (G4) of the first measure as shown in FIG. 4.

Further, when "grace note (two-tone-up)" is to be imparted to the leading note (B♭4) in the second measure of the musical score data, the user clicks on the grace-tone-up ("GrcUp") style of rendition, so that a plurality of grace-tone-up-candidate icons (not shown) are shown in the innermost style-of-rendition icon window. Then, once the user clicks on a two-tone-up icon and drags and drops the icon at the location of the leading note (B♭4) in the second measure of the musical score data, a two-tone-up icon GId is pasted at a location of the second layer L2 corresponding to the leading note (B♭4) of the second measure.

When "legato" is to be imparted, the user clicks on the "joint" state and then on a "legato" style tab (not shown in FIG. 4 because it is a style of rendition falling within the "joint" state), so that a style-of-rendition icon window "slur" (also not shown) shows up, in which several slur-candidate icons are presented. Thus, by the user dragging and dropping a desired one of the slur-candidate icons at a desired portion on the musical score, a desired slur icon SId can be pasted at a corresponding portion of the third layer L3.

Further, when "crescendo" is to be imparted, the user clicks on the "all" state and then on a "crescendo" (Crscn) style tab (not shown in FIG. 4 because it is a style of rendition falling within the "all" state), so that a style-of-rendition icon window "Crscn" (not shown) shows up, in which are presented several crescendo-candidate icons corresponding to several dynamic ranges and lengths over which to increase tones. Thus, by the user dragging and dropping a desired one of the crescendo-candidate icons at a desired portion on the musical score, a desired crescendo icon CId can be pasted at a corresponding portion of the first layer Li as shown in FIG. 4. It should be noted here that the music score may be shown on the display in any suitable manner other than in the normal or most popular "staff" notation; in any case, however, it is preferable that the performance information be arranged in a time series.

[Expansion/Contraction Editing of Style-of-rendition Icon]

Each of the articulation represented by the icons BId, GId, SId and GId thus pasted has a given depth and length (speed), which can be edited to desired values by the user expanding/contracting the figure of the icon BId, GId, SId or CId in either one or both of the vertical and horizontal directions.

For example, the horizontal dimension or width of each of the style-of-rendition icons pasted on the screen can be expanded or contracted by moving the mouse while clicking on the left or right outer frame portion or end of that icon in the horizontal direction. In this way, the length (speed) of the articulation represented by the style-of-rendition icon can be modified. Similarly, the vertical dimension of each of the style-of-rendition icons can be expanded or contracted by moving the mouse while clicking on the upper or lower outer frame portion or end of that icon in the vertical direction. In this way, the depth of the articulation represented by the style-of-rendition icon can be modified. Furthermore, by moving the mouse while clicking on one of the four corners of the style-of-rendition icon in an obliquely inward or outward direction, the vertical and horizontal dimensions of the icon can be simultaneously expanded or contracted so that both of the depth and length of the articulation can be modified at the same time.

Whereas the bend-up icon BId first pasted on the layer L2 has been described, in relation to the example of FIG. 4, as corresponding to the "deep and slow" bend-up candidate icon BI1 shown at the leftmost location within the style-of-rendition icon window, the initial bend depth can be made smaller to approach that of the "shallow and slow" bend-up candidate icon BI2 shown at the second leftmost location within the style-of-rendition icon window, by dragging, via the mouse, the upper or lower end of the icon BI1 inwardly to thereby contract the icon BI1 in the vertical direction.

Further, by dragging, via the mouse, the left or right end of the pasted "deep and slow" bend-up candiadate icon BId inwardly to thereby contract the icon BId in the horizontal direction, the length (speed) of the articulation can be increased to approach that of the "deep and quick" bend-up icon BI3 shown at the second rightmost location within the style-of-rendition icon window. Also, by dragging one of the corners of the outer frame of the icon BId inwardly toward the center of the icon BId to thereby contract the icon BId in the horizontal and horizontal direction, both the bend-up speed and the initial bend depth can be simultaneously reduced to approach that of the "shallow and quick" bend-up icon BI4 shown at the rightmost location within the style-of-rendition icon window.

Figure 5:
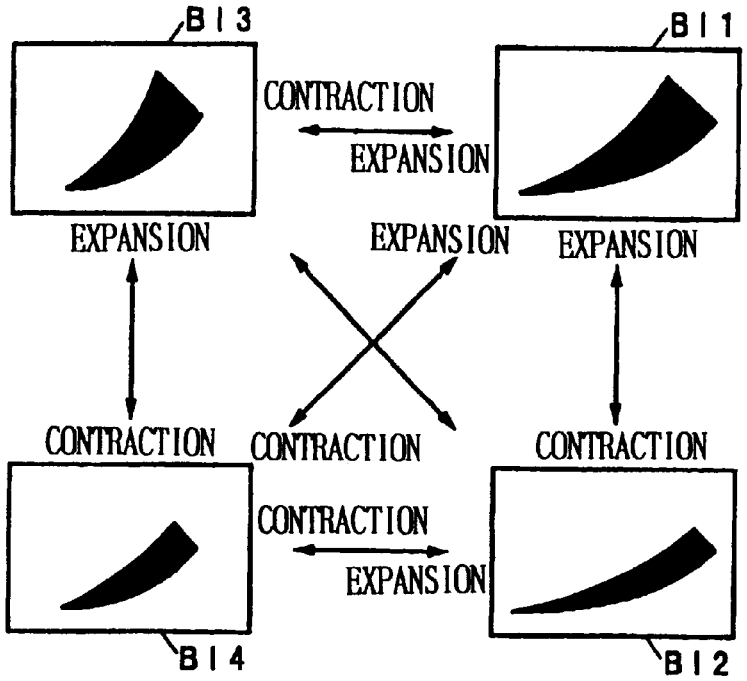
FIG. 5 is a diagram explanatory of how a style-of-rendition icon is edited for expansion or contraction in the style-of-rendition inputting apparatus of FIG. 1.

In the illustrated example of FIG. 5, each of the icons is varied in shape or figure along with its the vertical or horizontal expansion or contraction; however, only the size of the icon's outer frame may be expanded or contracted with its figure left unchanged. Further, predetermined upper and lower limits may be set to the expandable and contractible ranges of each of the icons. For example, the speed (horizontal dimension) of the "deep and slow" bend-up icon may be set to be incapable of being contracted below that of the "deep and quick" bend-up icon.

[Example 2 of Displayed Screen]

Figure 6:
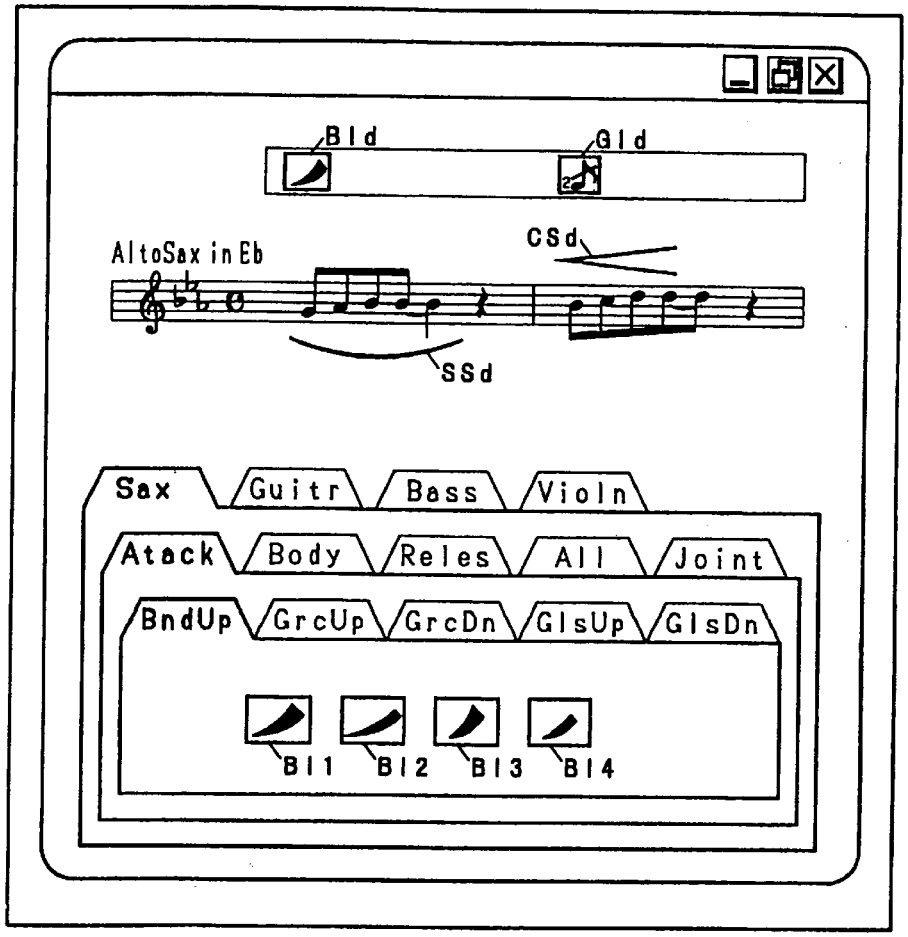
FIG. 6 is a diagram showing another example of the displayed screen in the style-of-rendition inputting apparatus FIG. 1.

FIG. 6 is a diagram showing example 2 of displayed screen in the style-of-rendition inputting apparatus according to the preferred embodiment of the invention. In this example of displayed screen, only one layer of the style-of-rendition display area is provided on one (upper) side of the original music-piece note data display area, and the traditional music notations are employed for some of the articulation styles or styles of rendition. This display mode will be called a "one layer plus traditional notation" display mode.

In contrast to the "three-layer pasting" display mode as exemplified by example 1 of displayed screen of FIG. 4, the "one layer plus traditional notation" display mode of FIG. 6 lacks the first and third layers L1 and L3, and the "crescendo" icon CId and "slur" icon SId, shown in the first and third layers L1 and L3 in the "three-layer pasting" display mode, are replaced by the corresponding traditional music notations CSd and SSd by reference to the standard music notations prestored in an articulation selection data storage section 26. In the other respects, however, the "one layer plus traditional notation" display mode of FIG. 6 is substantially similar to the "three-layer pasting" display mode. It should also be appreciated that all the styles of rendition described earlier as capable of being pasted on the first or third layers may be represented by the corresponding traditional music notations and that the "grace-tone-up/down", "chromatic-up/down", "flgliss-up/down", "staccato", "detache", etc. can also be represented by the traditional music notations.

[Test Listening and Recording of Input Data]

As mentioned above, the articulation instruction data AR is given by pasting a style-of-rendition icon onto the original music-piece note data MD. Further, once the icon operation data IM is given by the user expanding or contracting the pasted style-of-rendition icon in the vertical and/or horizontal direction, the icon selection section 25 selects the icon number IP1 corresponding to the pasted style-of-rendition icon and an icon-editing-value calculation section 27 calculates an icon expansion/contraction (i.e., icon editing) value IV1. Further, a note/velocity detection section 28 provides original music-piece parameters MP1 indicative of notes and velocities in the input original music-piece note data MD.

The above-mentioned data IP1, IV1 and MP1 are recorded, via a data recording section 29, into a sequence memory 30 as performance sequence data IP2, IV2 and MP2 in accordance with progression of the original music-piece note data, and the data IP2, IV2 and MP2 thus recorded in the sequence memory 30 can be reproduced via a data reproduction section 31 as necessary. Thus, by selecting the icon number IP1, editing the figure of the icon with the editing value IV1 and activating a predetermined test-listening button, the music piece, which is being currently subjected to an articulation setting/editing process, can be sounded through the tone generator section of FIG. 3 for test-listening of its details. Further, upon completion of the articulation setting, the music piece having desired articulation imparted thereto can be caused to sound via the tone generator section of FIG. 3 on the basis of the icon number IP2 and icon expansion/contraction value IV2 stored in the sequence memory 30.

[Hierarchical Structure of Style-of-rendition parameters]

Figure 7:
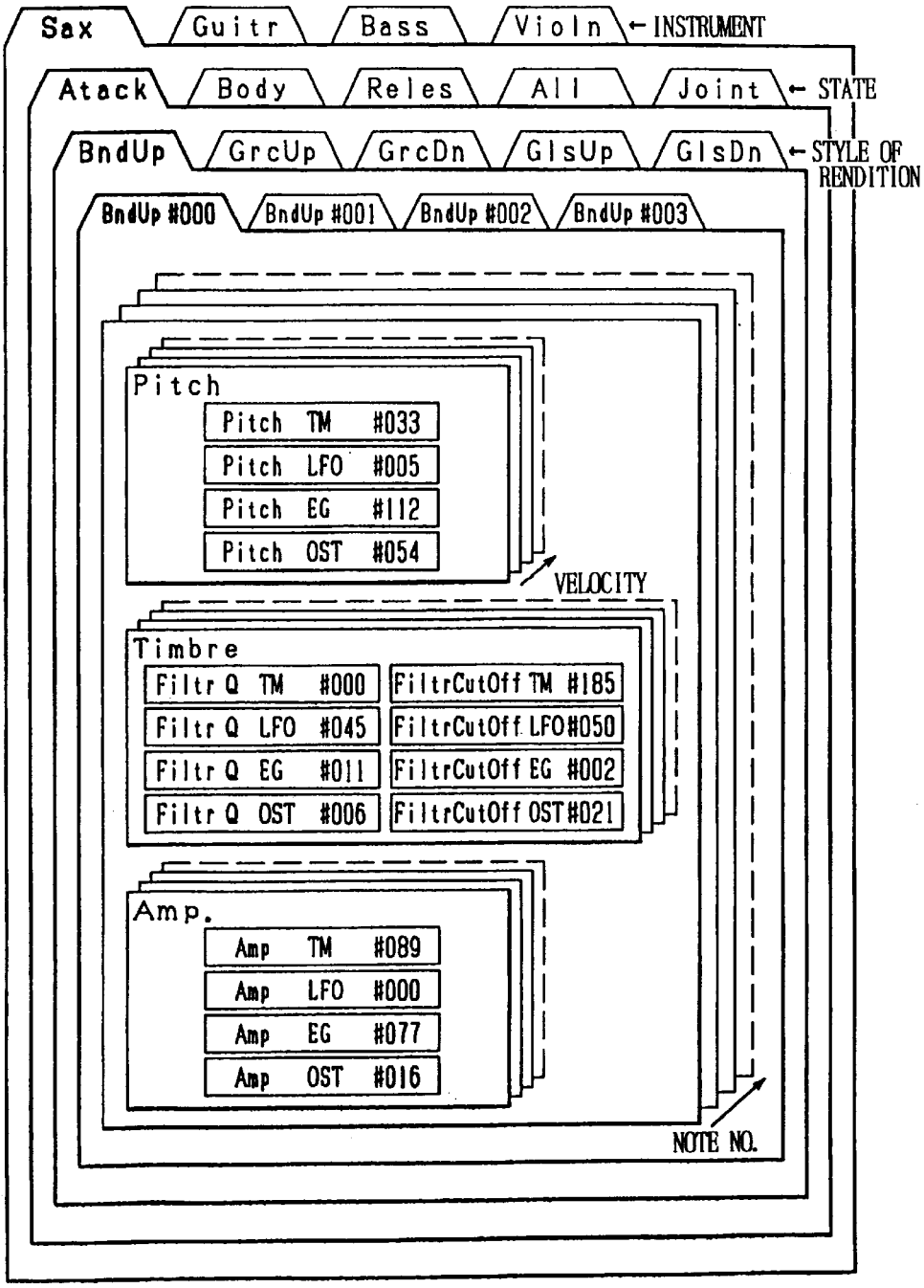
FIG. 7 is a diagram showing an example of a hierarchical structure of style-of-rendition parameters employed in the apparatus FIG. 1.

In FIG. 7, there is shown an example of a hierarchical structure of the style-of-rendition parameters, employed in the style-of-rendition inputting apparatus in accordance with the preferred embodiment of the present invention, in the form of tabbed files similarly to the examples of FIGS. 4 and 6. The style-of-rendition parameters are first classified according to various musical instrument types to which they pertain, such as "saxophone (Sax)", "guitar (Guitr)", "bass" and "violin (Violn)". Then, the style-of-rendition parameters in each of the musical instrument types are subclassified according to various articulation states, such as "attack (Atack)", "body", "release (Reles)", "all" and "joint". Then, the style-of-rendition parameters in each of the articulation states are further subdivided according to a plurality of styles of rendition based on the instrument type and state. For example, the style-of-rendition parameters in the "attack" state of "saxophone" are subclassified according to the styles of rendition, such as "bend-up (BndUp)", "grace-tone-up (GrcUp)", "grace-tone-down (GrcDn)", "glissando-up (GlsUp)" and "glissando-down (GlsDn)".

Furthermore, the style-of-rendition parameters in each of the styles of rendition are subdivided into a plurality of style-of-rendition icons identified by respective unique icon numbers. For instance, the bend-up candidate icons BI1–BI4 of FIGS. 4 and 6 correspond to style-of-rendition tabs "BndUp #000" – "BndUp #003" of FIG. 7. The style-of-rendition parameters in each of the style-of-rendition icons are further subdivided into a plurality of note numbers (note number groups), so that the parameters in each of the styles of rendition are further divided into banks based on the note numbers. Furthermore, the style-of-rendition parameters in each of the note numbers (note number groups) are subdivided into a plurality of velocity groups, so that the parameters are further divided into banks based on the velocities. Moreover, for each of the velocities, a pointer to an actual style-of-rendition parameter is stored for each of a plurality of parameters such as template (TM), low-frequency oscillator (LFO), envelope generator (EG) and offset (OST); thus, for each of the banks, the pointer indicates which of the style-of-rendition parameters should be used.

It should be appreciated that the present invention may employ any hierarchical structure of the style-of-rendition parameters other than the one illustratively shown in FIG. 7. For example, the style-of-rendition parameters in each of the style-of-rendition icons may be first subclassified according to the velocities and then further subclassified according to the note numbers. Further, the bank-by-bank division based on the velocities and note numbers may be placed on a higher level than the musical instrument classification. In another alternative the bank-by-bank division may be made in a two-dimensional space of the note number and velocity and individual areas in the two-dimensional space may be associated with these banks.

[Actual Style-of-rendition Parameter]

Figure 8:
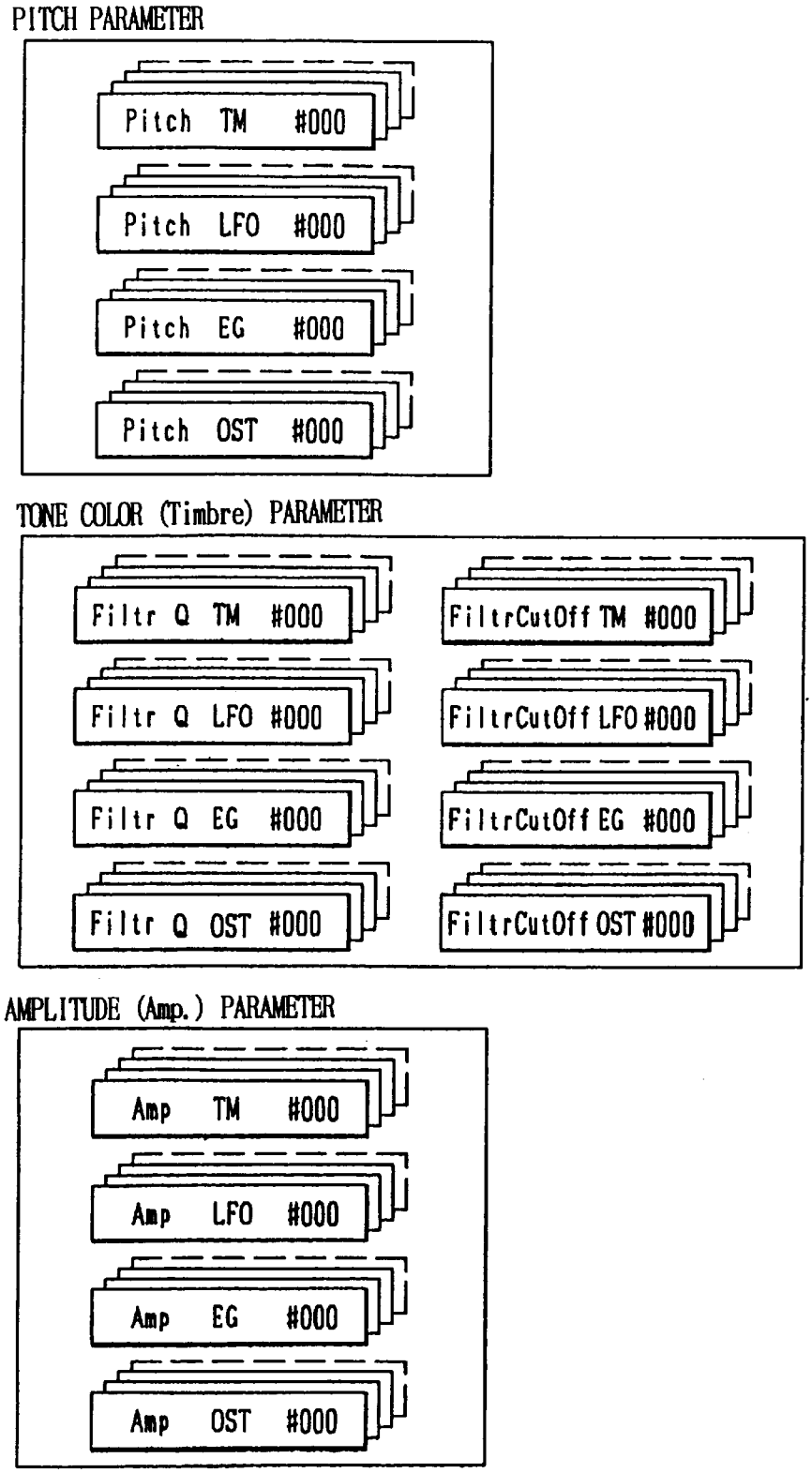
FIG. 8 is a diagram showing an exemplary storage format of actual style-of-rendition parameters used in the style-of-rendition inputting apparatus of FIG. 1.

In FIG. 8, there is shown an exemplary storage format of the actual style-of-rendition parameters used in the style-of-rendition inputting apparatus in accordance with the preferred embodiment of the present invention, where various style-of-rendition parameters, such as tone pitch ("Pitch"), tone color ("Timbre") and amplitude (Amp.), are stored in a simple sequential order. The template ("TM") represents a time series of parameters whose values vary over time, while the low-frequency oscillator ("LFO"), envelope generator ("EG") and offset ("OST") represent fixed parameters whose values do not vary over time.

Figure 9:
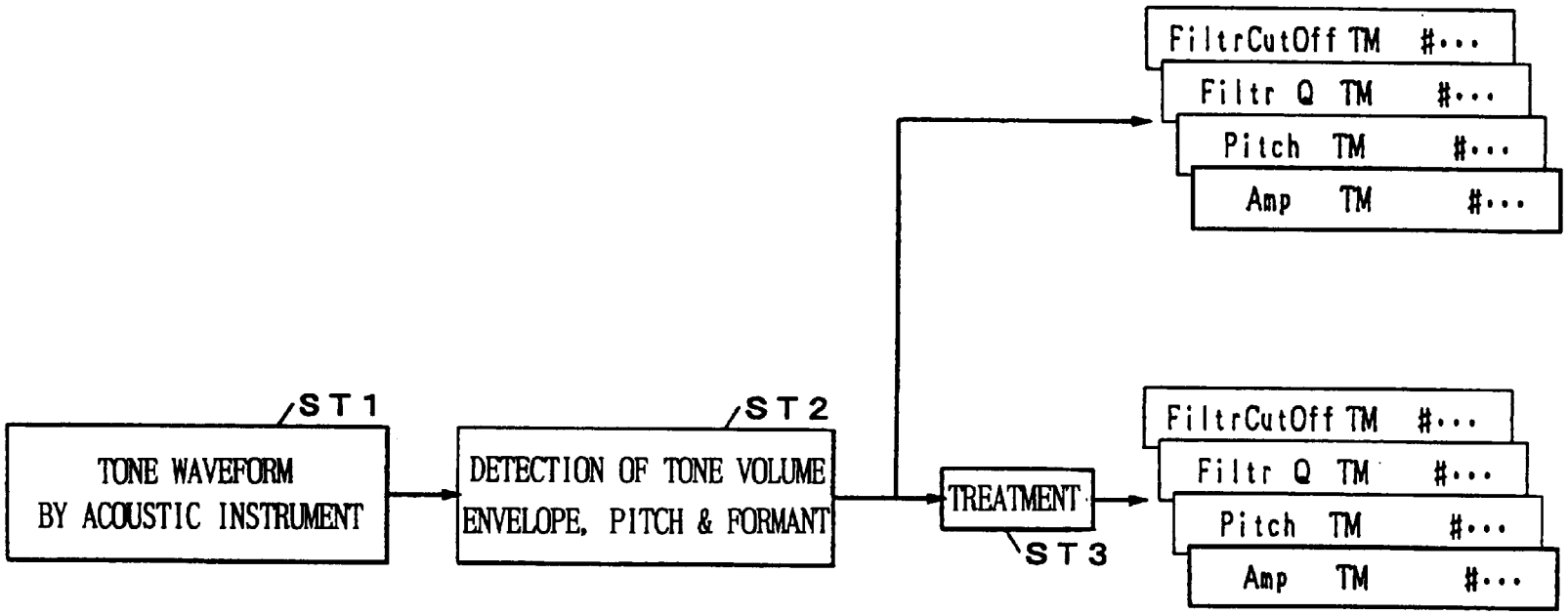
FIG. 9 is a block diagram showing an operational flow for creating template data of individual style-of-rendition parameters used in the style-of-rendition inputting apparatus of FIG. 1.

Further, FIG. 9 shows an operational flow for acquiring "template" data of the individual style-of-rendition parameters. At first step ST1, various tone waveforms are input which were obtained by actually performing various acoustic musical instruments in various styles of rendition. At next step ST2, a time-varying tone volume envelope, pitch, formant, etc. are detected for each of the input tone waveforms and these detected data are sampled at a predetermined sampling frequency, so as to create templates of a cut-off frequency and Q of a tone color filter, pitch and amplitude. At following step ST3, similar templates are created which include slight treatments applied thereto manually by a human operator. In this way, there can be created various templates which can suitably approximate the actual acoustic musical instruments.

Figure 10:
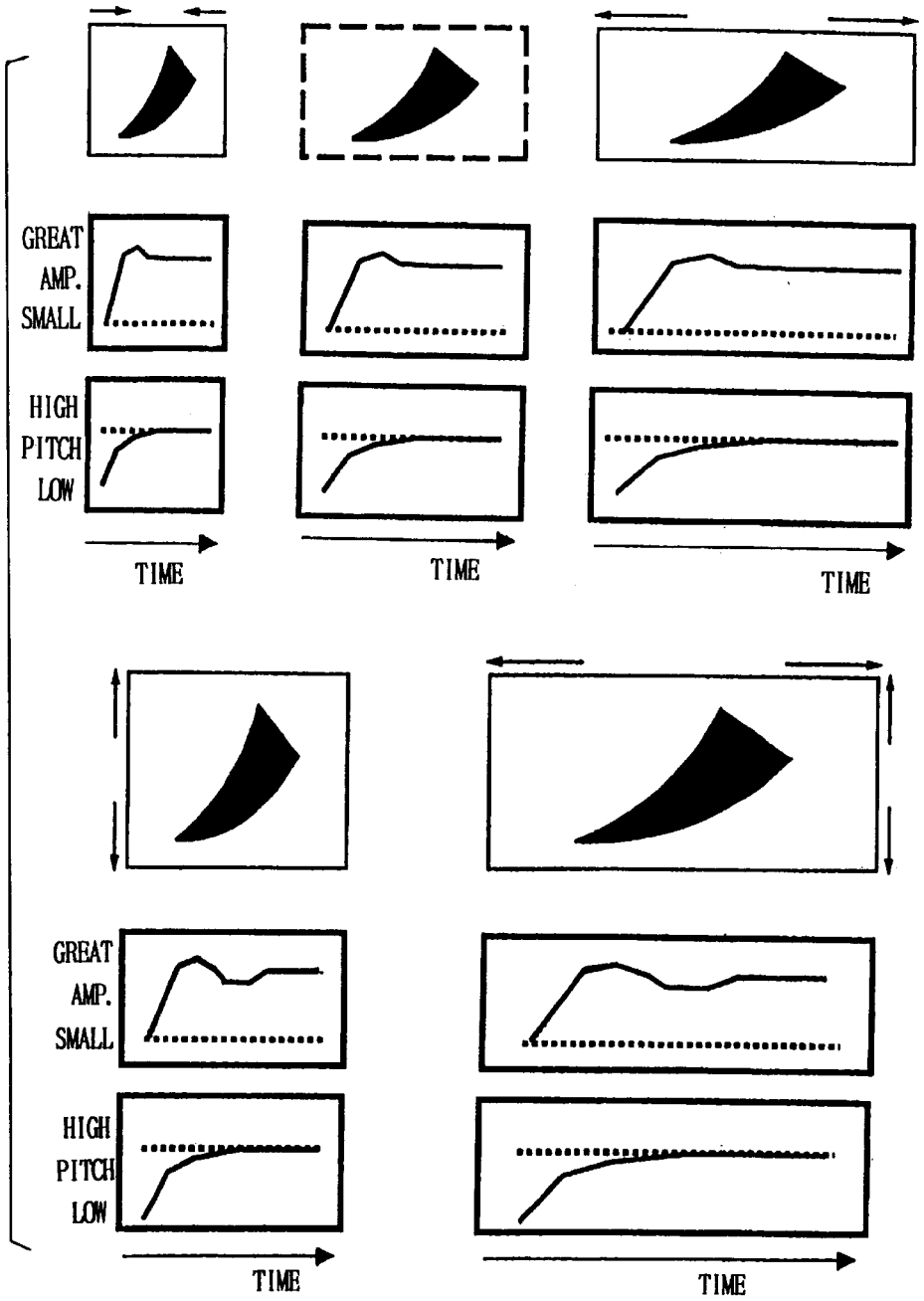
FIG. 10 is a diagram showing an exemplary relationship between style-of-rendition icons and style-of-rendition parameters in the style-of-rendition inputting apparatus of FIG. 1.
Figure 11:
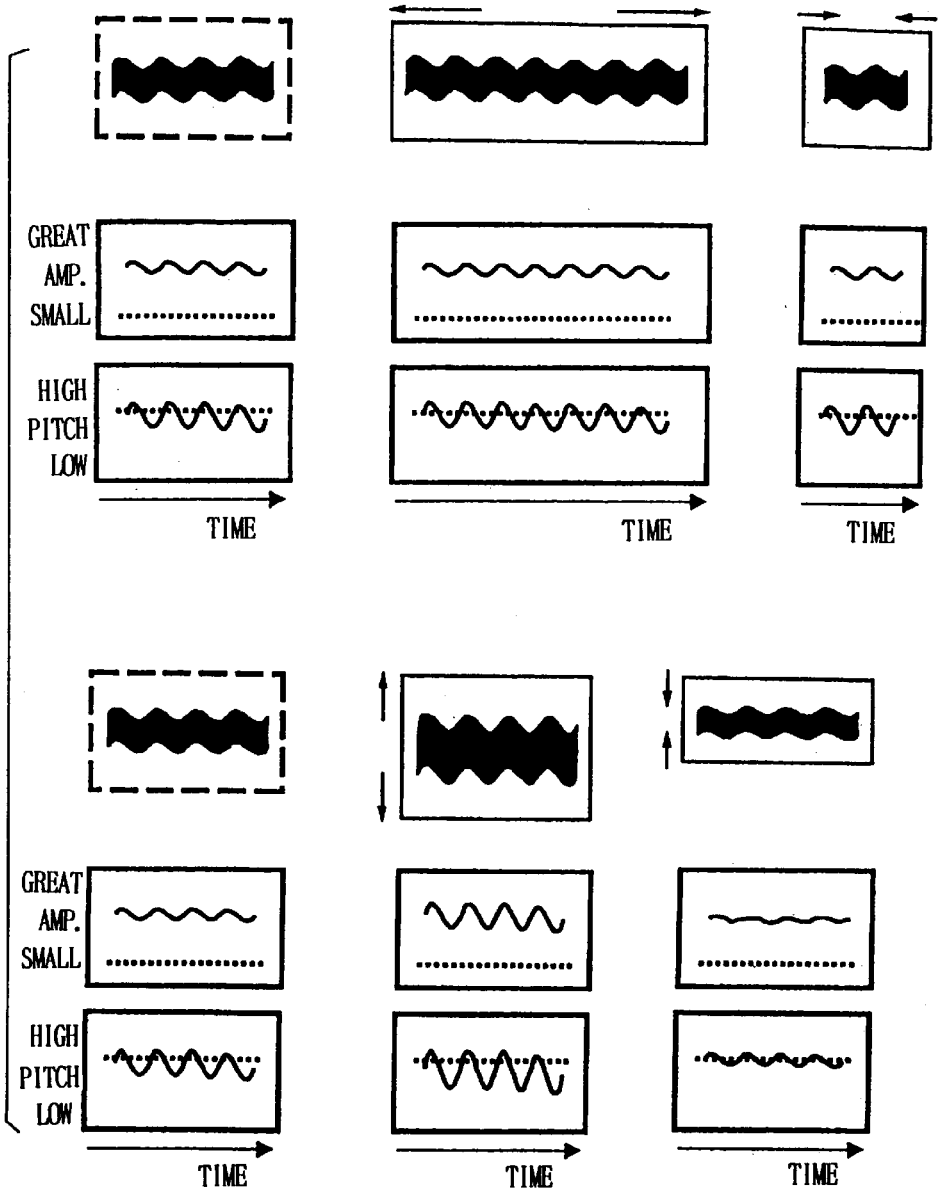
FIG. 11 is a diagram showing another exemplary relationship between the style-of-rendition icons and the style-of-rendition parameters in the style-of-rendition inputting apparatus of FIG. 1.

Referring now to FIGS. 10 and 11, there are shown exemplary relationships between the style-of-rendition icons and the style-of-rendition parameters employed in the preferred embodiment of the present invention. In each of these figures, horizontal dotted lines within the style-of-rendition icons in second and third rows from the top denote reference levels, i.e., a zero amplitude level and a reference pitch corresponding to a note number.

More specifically, FIG. 10 shows an exemplary relationship between the bend-up icon and amplitude ("Amp") and tone pitch parameters. As the bend-up icon of a reference expansion/contraction ("ex./con." in the figures) value, enclosed within a dotted-line frame in the middle of the top row, is contracted or expanded in the horizontal direction as represented in a left or right frame in the top row, the variations per time in the amplitude and tone pitch parameters are made greater or smaller as shown. Further, as the icon is expanded in the vertical direction as denoted in a left frame of the fourth row, not only the time variation amount or rate of the amplitude parameters increase but also the shape of the icon greatly varies as compared to the above-mentioned reference icon within the dotted-line frame, and the tone pitch parameters also greatly increase from a lower start level, which thereby increases the depth of the bend-up. Further, as the icon is expanded in the vertical and horizontal directions as denoted in a right frame of the fourth row, the overall variation amounts of the amplitude and tone pitch parameters increase but the variation amounts per time (i.e., variation rates) decrease, which thereby increases the depth of the bend-up but decreases the bend-up speed.

Further, either one of the following two approaches can be employed in horizontally contracting or expanding the time-serial parameters having non-repetitive characteristics as shown in FIG. 10:

(1) The above-mentioned sampling frequency is changed; that is, time intervals between the time-serial parameters, dispersedly stored in the memory, is changed.

(2) New sample value at each sampling point of the horizontally contracted or expanded time-serial parameters is arithmetically calculated with the above-mentioned sampling frequency left unchanged.

The former approach can be readily realized through application of the pitch-synchronized waveform sample value creating technique as in the waveform-memory-based tone generators, while the latter approach can be readily realized through application of the non-pitch-synchronized waveform sample value creating technique (i.e., by using the sample values of the time-serial parameters in place of the sample values stored in the waveform memory).

Further, FIG. 11 shows an exemplary relationship between the "vibrato" icon and amplitude ("Amp") and tone pitch parameters. As the vibrato icon of a reference expansion/contraction value enclosed within a dotted-line frame in the top row is expanded or contracted in the horizontal direction as represented in middle and right frames in the top row, a frequency of upward and downward variations in the parameter values is increased or decreased as shown, which thereby increases or decreases a tone vibrating frequency. Further, as the reference vibrato icon is expanded or contracted in the vertical direction as represented in a lower half of the figure, the values of the two parameters are increased or decreased as shown, which thereby increases or decreases a tone vibration degree.

The following approaches can be employed in horizontally contracting or expanding the time-serial parameters having repetitive characteristics as shown in FIG. 11:

(1) In the case of the icon expansion, a start and end of a specific part or whole of the time-serial parameters are set as a loop start point and loop end point, respectively, and readout of the time-serial parameters is repeated by returning to the loop start point upon arrival at the loop end point.

(2) In the case of the icon contraction, the readout of the time-serial parameters is terminated along the way.

The former approach can be readily realized through application of the looping technique as in the waveform-memory-based tone generators.

[Creation of Performance Data]

Now, reference is made back to FIG. 3 to describe details of the tone generator section. Once the data IP1, IV1 and MP1 output from the icon selection section 25, icon-editing-value calculation section 27 and note/velocity detection section 28 and the data IP2, IV2 and MP2 output from the data reproduction section 31 are given to the tone generator section of FIG. 3 in response to a test-listening or performance instruction, predetermined waveform data MW of a specific bank corresponding to the given note and velocity is selected, via a waveform bank selection section 33, from the waveform memory 32 in accordance with the original music-piece parameters MP1/MP2 and musical instrument type (not shown in the figure).

Further, icon parameter selection sections 37–39 are connected to style-of-rendition parameter memories 34–36, respectively, which store the style-of-rendition parameters of tone pitch ("Pitch"), tone color ("Timbre") and amplitude ("Amp."). The icon parameter selection sections 37–39 extract the tone pitch, color and amplitude parameters, for all the banks, corresponding to the currently-selected style-of-rendition icon on the basis of the icon number IP1/IP2. Bank parameter selections 40 42, connected to respective outputs of the icon parameter selection sections 37–39, extract only necessary parameters from among the parameters of all the banks on the basis of the original music-piece parameters MP1/MP2 (note number and velocity value).

Further, on the basis of the icon expansion/contraction data IV1/IV2, parameter modification sections 43–45 modify the parameters extracted by the corresponding bank parameter selection 40–42 and supply the thus-modified tone pitch, tone color and amplitude parameters PP, PT and PA to tone pitch, tone color and amplitude synthesis sections 46–48, respectively.

The waveform data MW selectively read out from the waveform memory 32 is passed to the tone pitch synthesis section 46 where its tone pitch is controlled in accordance with the tone pitch parameter PP, then sent to the tone color synthesis section 47 where its tone color is controlled in accordance with the tone color parameter PT, and then sent to the amplitude synthesis section 48 where its tone volume is controlled in accordance with the tone volume parameter PA, so that it is audibly sounded through a sound system 49 as a tone with desired articulation imparted thereto.

FIG. 12 is a diagram showing an exemplary listing of the style-of-rendition icons provided for the individual musical instruments. In the preferred embodiment of the invention, as shown here, the style-of-rendition icons are provided in corresponding relation to the musical instruments to be played and the articulation states. For identical or similar articulation, one particular style-of-rendition icon is shared between a plurality of the musical instruments. For instance, the "crescendo", "decrescendo" and "vibrato" icons are each shared among four musical instruments, and the "staccato", "tenuto" and "slur" icons are each shared between saxophone and violin. Thus, the shared use of these style-of-rendition icons will substantially facilitate user manipulation of the icons. However, because different style-of-rendition parameters are selected for each of the musical instruments whether the same style-of-rendition icon is shared or not, articulation unique or peculiar to the musical instrument can be obtained by the preferred embodiment.

Further, according to the preferred embodiment of the invention, many different style-of-rendition-candidate icons are provided and displayed for a variety of articulation styles necessary for the musical instruments and articulation states, while no style-of-rendition-candidate icon is displayed for each articulation that could not be possessed by the musical instruments to be played. For example, although the "bend-up", "grace-tone-up", "gracetone-down", etc. are displayed for the "attack" state of "saxophone", the "hammer-on", "pull-off" etc. are not displayed. With this arrangement, articulation suited for a particular musical instrument to be pplyed can be imparted very efficiently.

Further, for the attack, body and release states of all the musical instruments, "normal" style-of-rendition icons are provided as a default. Namely, when the user does not perform any operation to paste a style-of-rendition icon in any one of the states, the "normal" style-of-rendition icon is automatically pasted on the display screen (e.g., on the second layer L2 in the three-layer pasting display mode of FIG. 4) and can be edited for expansion or contraction as desired. Then, at the time of an actual performance, default parameters preset for the "normal" styles of rendition are automatically applied. Note that these "normal" style-of-rendition icons, in practice, need not necessarily be pasted and shown on the display.

Figure 13:
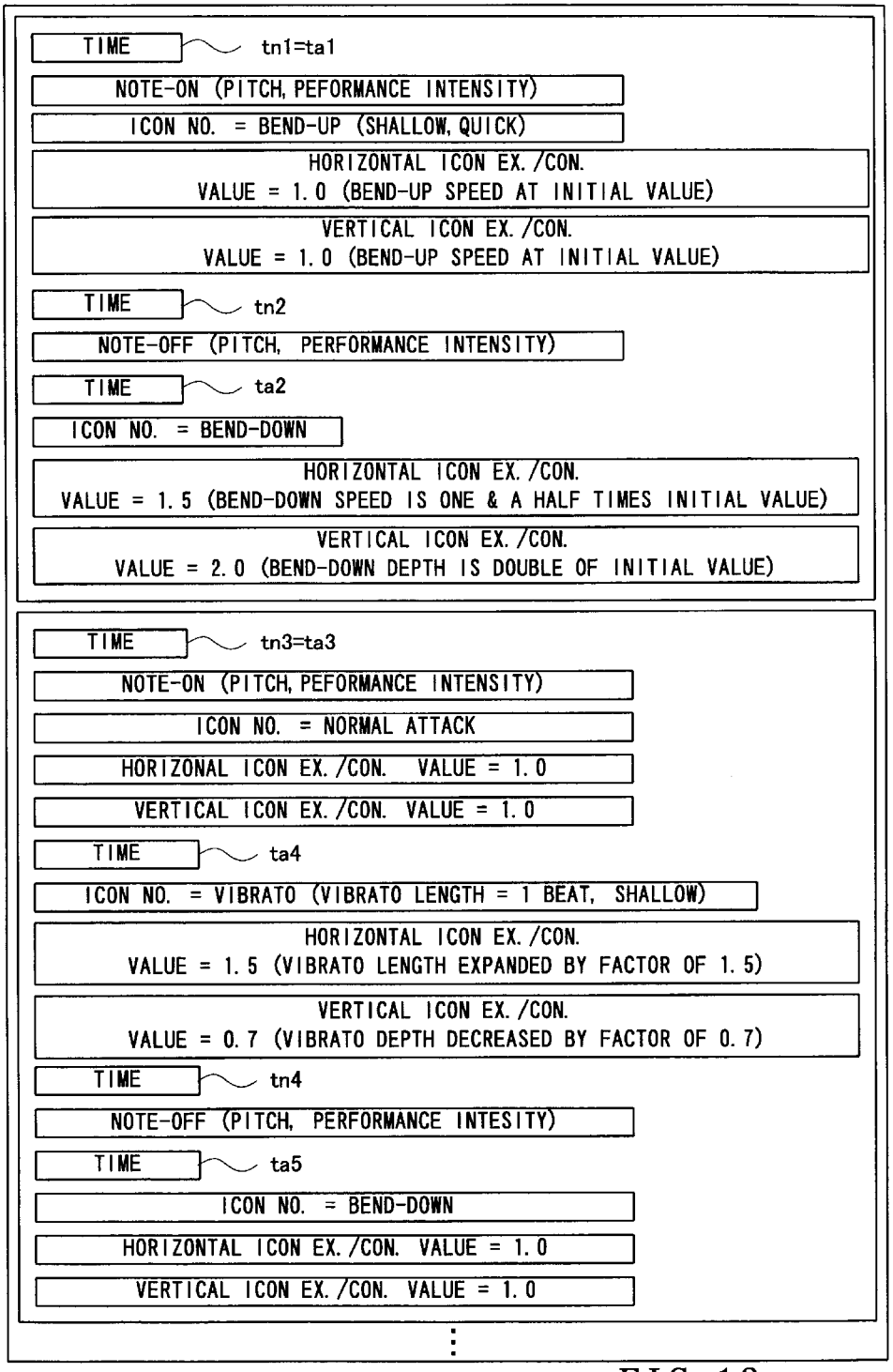
FIG. 13 is a diagram showing an exemplary storage format of performance sequence data with style-of-rendition icons pasted thereto via the style-of-rendition inputting apparatus of FIG. 1.

FIG. 13 is a diagram showing an exemplary storage format of performance sequence data with style-of-rendition icons pasted thereto via the style-of-rendition inputting apparatus in accordance with the preferred embodiment of the present invention. In the illustrated example of FIG. 13, the selected musical instrument is "saxophone", and a leading or first note in the original music-piece note data MD is turned on or sounded at a time tn1=ta1 indicated in a top row of the diagram, the notation "tn1=ta1 " here means that same time data is shared between the note and articulation. In the next three rows of the diagram, it is indicated that at the time tn1=ta1 corresponding to a pasting start location of an attack-state style-of-rendition icon imparted to the first note (specifically, the "shallow and quick bend-up" icon such as represented by "BI4" of FIG. 4), style-of-rendition parameters selected in accordance with the unique icon number of this style-of-rendition and tone pitch (note number) and performance intensity (velocity) of the first note should be set into the corresponding synthesis sections 46–48 of FIG. 3 so as to initiate the corresponding articulation. The articulation performed here is normally subjected to expansion/contraction of its depth (vertical dimension) and length (horizontal dimension) by expansion/contraction editing of the style-of-rendition icon pasted to the first note; however, in the illustrated example, the expansion/contraction editing values are set to the reference value of "1.0" so that the preset initial values are used for the pasted style-of-rendition icon.

At a next time tn2, an instruction is given to turn off the first note. Data following a time ta2 indicate that at the time ta2 corresponding to a pasting start location of a next style-of-rendition icon (one of a plurality of "bend-down" candidate icons provided for the release state), the articulation corresponding to the icon number of the next style-of-rendition icon should be initiated. In the illustrated example, the speed and depth of this articulation is edited and the style-of-rendition icon is set to a horizontal expansion/contraction value of "1.5" and a vertical expansion/contraction value of "2.0", so that style-of-rendition parameters obtained by modifying the initial values of the pasted style-of-rendition icon are set into the corresponding synthesis sections 46–48 for impartment of the articulation.

For a second note to be turned on at a time tn3=ta3, no icon selection by the user has been made in the initial attack state, the "normal" attack articulation is imparted automatically. Namely, data in the following three rows indicate that at the time tn3 of the default "normal" attack, the style-of-rendition parameters corresponding to the default icon number should be set with a predetermined expansion/contraction value of "1.0".

After that, data are stored in memory which indicate that starting at a time ta4 corresponding to a pasting start location of a next style-of-rendition icon (one of a plurality of body state "vibrato" candidate icons which has a vibrato length of one beat to provide a shallow vibrato and which will hereinafter be called a "one-beat-length shallow vibrato" icon), the articulation corresponding to the icon number of the next style-of-rendition icon is to be initiated. For this articulation, editing has been made to horizontally expand the pasted "one-beat-length shallow vibrato" icon by a factor of "1.5" and also vertically contract the "one-beat-length shallow vibrato" icon by a factor of "0.7", so that, at the time of an actual performance, the style-of-rendition parameters corresponding to the icon number are modified via the parameter modification sections 46–48 in such a way that the vibrato frequency increases by a factor of 1.5 and the vibrato depth decreases by a factor of 0.7.

Then, at a time tn4, an instruction is given to turn off the second note. After that, data are stored in memory which indicate that starting at a time ta5 corresponding to a pasting start location of a next release-state style-of-rendition icon, release articulation corresponding to the icon number of the next style-of-rendition icon should be effected without modification by expansion/contraction editing, i.e., with the initial value of "1.0". After that, the following data are stored in memory sequentially to provide performance sequence data for the individual musical instruments.

Note that because it is difficult to set, on the display, precise icon pasting start locations for the articulation start time points ta1–ta5, they are, in effect, automatically set to reference timing corresponding to the respective states of the style-of-rendition icons. For example, the start location of the attack state icon is set to coincide with the note-on timing, the start location of the body state icon is set to be in between the note-on and note-off timing so that the time-serial style-of-rendition parameters are located between the note-on and note-off timing, and the start location of the release state icon is set at predetermined timing when supply of the time-serial parameters is finished simultaneously with tone deadening (silencing) timing (i.e., a time point at which the tone volume reaches a substantial zero level) (more specifically, the predetermined timing precedes the tone deadening (silencing) timing by the length of the horizontally-expanded or contracted time-serial style-of-rendition parameters). Further, the start location of the all or joint state icon is set at such timing as to apply to a plurality of selected successive tones and the style-of-rendition parameters are supplied to the various processing blocks 43–45 and 46–48 of the tone generator section.

Furthermore, the thus-set timing may be adjusted subtly by the user. Whereas, in the above-described example, the note data and attack-state style-of-rendition icon share the time data because they are identical in timing, separate time data may of course be imparted to the two data. Moreover, the present invention should not be construed as being limited only to the above-described scheme where the style-of-rendition icon numbers and expansion/contraction values are embedded in the note data; it may employ another scheme where actual parameters obtained by deploying the style-of-rendition icon numbers and expansion/contraction values in actual style-of-rendition parameters are embedded in the note data. By so doing, an articulation-imparted performance is permitted even when reproduced performance data have been supplied to a tone generator system having no style-of-rendition parameter stored therein. Furthermore, arrangements may be made to permit data conversion between the these two schemes.

[Operational Flow of Style-of-rendition-Icon Pasting Process]

Figure 14:
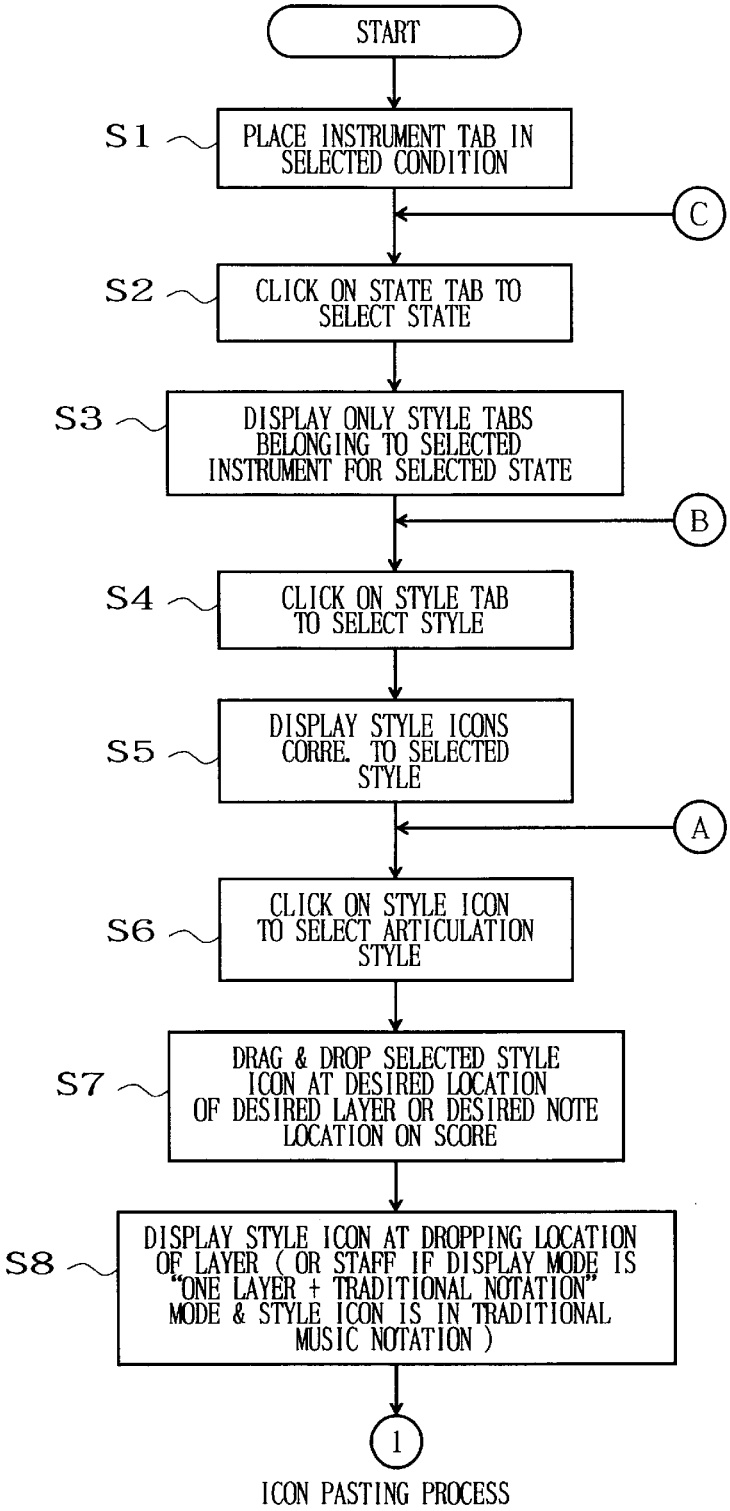
FIG. 14 is a flow chart showing a part of a style-of-rendition-icon pasting process carried out in the style-of-rendition inputting apparatus of FIG. 1.
Figure 15:
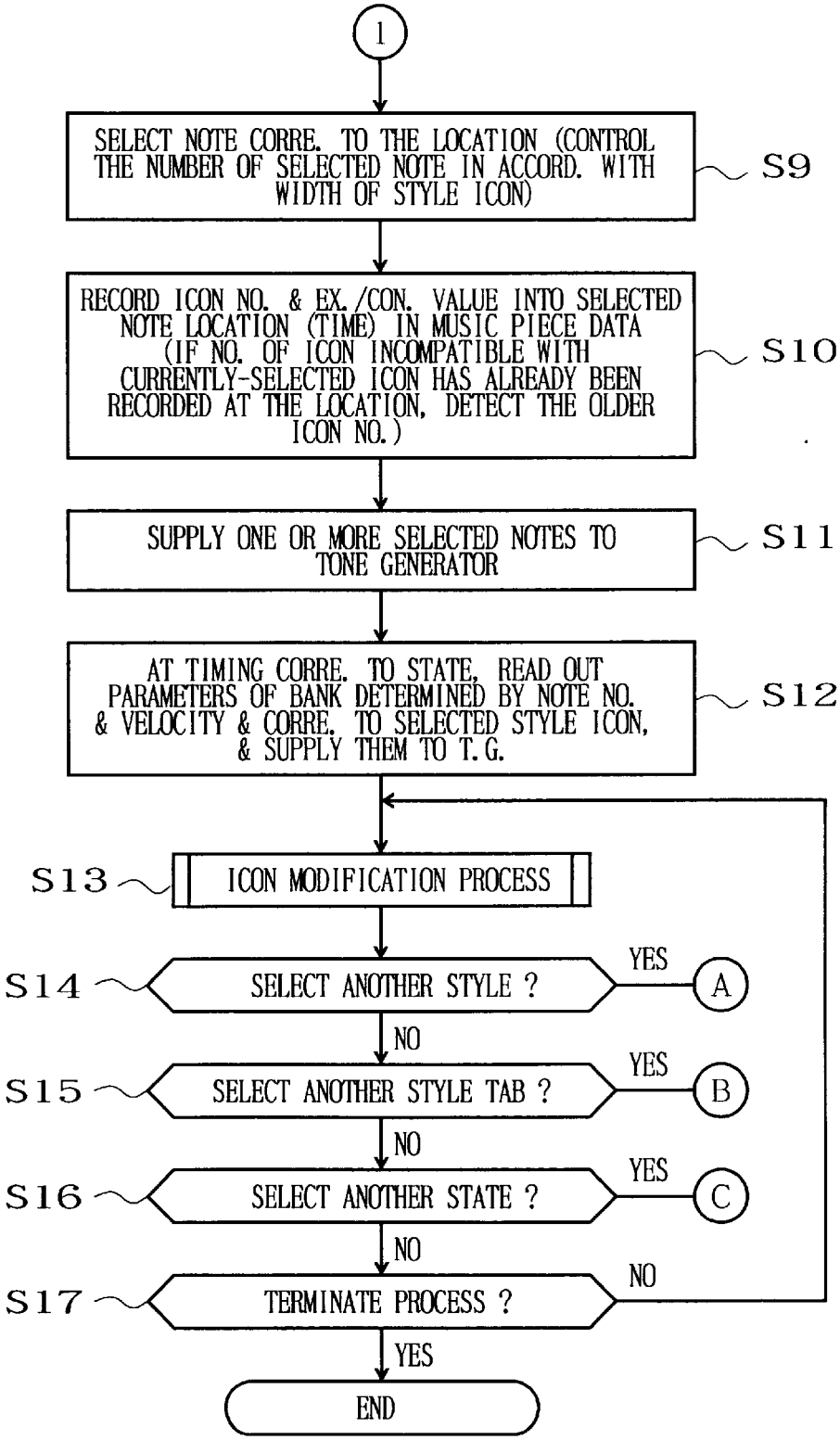
FIG. 15 is a flow chart showing the remaining part of the style-of-rendition-icon pasting process carried out in the style-of-rendition inputting apparatus of FIG. 1.

FIGS. 14 and 15 are flow charts showing a style-of-rendition-icon pasting process carried out in the style-of-rendition inputting apparatus in accordance with the preferred embodiment of the present invention. This style-of-rendition-icon pasting process is directed mainly to dragging and pasting a style-of-rendition icon to a note on a musical score as illustratively shown in example 1 or 2 of displayed screen of FIG. 4 or 6. Namely this pasting process uses a plurality of layers to display style-of-rendition icons in plural areas separate from the musical staff as seen in the "three-layer pasting" display mode according to example 1 of displayed screen of FIG. 4, or displays some articulation styles (styles of rendition) in the musical staff using the traditional notations as seen in the "one layer plus traditional notation" display mode according to example 2 of displayed screen of FIG. 6.

At first step Si of the style-of-rendition-icon pasting process, one of the musical instrument tabs is placed in a selected condition in accordance with an instrument part of original music-piece note data MD to be edited. For instance, if the selected instrument part is "saxophone", the musical instrument tab "Sax" is automatically placed in the selected condition. Note that the musical instrument may of course be selected manually by clicking, via the mouse, on the corresponding tab rather than by such an automatic selection of the musical instrument tag. At next step S2, a desired one of the articulation states is selected by clicking on the corresponding tab. In each of the displayed screens of FIGS. 4 and 6, the "attack" state is being currently selected by clicking on the "Atack" tab.

At following step S3, only the articulation tabs corresponding to the musical instrument selected at step Si are selected for the state selected at step S2. In each of the examples of displayed screen of FIGS. 4 and 6, only "bend-up", "grace-tone-up", "grace-tone-down", "glissando-up" and "glissando-down" are being displayed as the style-of-rendition tabs of the "attack" state of "saxohone" without "hammer-on", "pulling-off", etc. of guitar, bass etc. being displayed.

Then, at step S4, a desired style of rendition is selected from the style-of-rendition tabs displayed on the screen. In each of the examples of displayed screen of FIGS. 4 and 6, the "bend-up" style is being selected by clicking on the "BndUp" tab. At step 5, the style-of-rendition icons corresponding to the style selected at step S4 are displayed; in each of the examples of displayed screen of FIGS. 4 and 6, the four bend-up candidate icons BI1–BI4 corresponding to the bend-up style are being displayed.

Then, at step S6, a desired articulation style (style of rendition) is selected by clicking on one of these displayed icons, and at step S7, the clicked-on style-of-rendition icon is dragged to and dropped at a desired location of the screen corresponding to a predetermined note of the original music-piece note data MD to which the articulation is to be imparted. For example, in each of the examples of displayed screen of FIGS. 4 and 6, the leftmost "deep and slow bend-up" icon BI1 is selected and dragged to and dropped at a location corresponding to the leading note (G4) in the first measure of the original music-piece note data MD. In this case, the selected style-of-rendition icon may be dragged to and dropped at either a note on the displayed musical score or a designated dropping location in one of the layers to which the style-of-rendition icon corresponds.

Then, at step S8, the selected style-of-rendition icon is displayed at the designated dropping location of the layer corresponding to the selected icon. In the "three-layer" display mode as in example 1 of displayed screen of FIG. 4, the bend-up style belongs to the second layer L2 and thus the "deep and slow bend-up" icon BId is displayed at the corresponding dropping location of the second layer L2. Further, as already described in relation to FIG. 4, the grace note icon GId is also displayed at a corresponding dropping location on the second layer L2, the crescendo icon CId on the first layer L1, and the slur icon SId on the third layer L3.

In the case of the "one layer plus traditional notation" display mode as in example 2 of displayed screen of FIG. 6, step S8 of FIG. 14, as noted in parenthesis, displays, on the musical staff, every articulation style (style of rendition) that can be represented in the traditional notation such as the standard music notation, but displays other articulation styles (styles of rendition) on the layer.

At next step S9, a note or notes corresponding to the displayed location of the style-of-rendition icon (or traditional notation) are selected from among the original music-piece note data MD. For example, a single note is selected for the "attack", "body" or "release" state of the bend-up icon BId or grace-tone-up icon GId as shown in FIG. 4 or 6, but a specific number of notes corresponding to the horizontal length or width (e.g., two-beat length) of the style-of-rendition icon are selected for the "all" or "joint" state of the crescendo icon CId or slur SId.

At following step S10, an icon number IP1 and expansion/contraction value IV1 (initial value "1.0" for both the vertical and horizontal dimensions) are determined in accordance with a time position of the note selected from among the original music-piece note data MD and then recorded into the sequence memory 30 along with time data corresponding to the above-mentioned reference timing. However, in case an icon number of a certain icon incompatible with the currently-selected style-of-rendition icon is already recorded at the time position, the already-recorded or older icon number is deleted. For example, in the case of the "grace-tone-up" and "grace-tone-down" icons representative of similar styles of rendition that can not coexist with each other, the older or already-recorded icon is deleted to allow the new icon to be recorded in place of (with priority over) the older icon. The thus-deleted style-of-rendition icon is also deleted from the displayed screen.

At next step S11, data of the selected one or more notes are supplied to the tone generator section of FIG. 3. Specifically, note-on event data is first supplied and then note-off event data is supplied after a predetermined time interval from the note-on event data. In the case where a plurality of notes have been selected, a plurality of pairs of the note-on and note-off event data are supplied to the tone generator section in accordance with their respective generation timing and order.

At next step S12, the style-of-rendition parameters of a particular bank determined by the note number and velocity are read out in corresponding relation to the selected style-of-rendition icon at timing corresponding to the selected state (i.e., at the above-mentioned reference timing), and the thus-read-out parameters are supplied to the various processing blocks 43–45 and 46–48 of the tone generator section in such a way that the supply is completed at predetermined timing: simultaneously with the note-on timing if the selected style-of-rendition icon is of the attack state; in between the note-on and note-off timing so that the time-serial style-of-rendition parameters are located between the note-on and note-off timing, if the selected style-of-rendition icon is of the body state; simultaneously with tone deadening (silencing) timing if the selected style-of-rendition icon is of the release state; and at timing such that the parameters apply to a plurality of selected notes if the selected style-of-rendition icon is of the all or joint state. Through the operations of steps S11 and S12, the user is allowed to test-listen to a tone having imparted thereto articulation corresponding to the selected style-of-rendition icon.

Next step S13 is directed to an icon modification (editing) process routine. If a certain modification is to be made to the articulation as a result of the test-listening, the corresponding style-of-rendition icon can be modified as desired through the icon modification (editing) process routine as will be described later with reference to FIG. 17. In case the style-of-rendition icon is to be modified to a relatively great extent as a result of the test-listening, the style-of-rendition-icon pasting process moves on to step S14 for selection of another style-of-rendition icon, or if a style-of-rendition icon is to be pasted for another note, the same or other suitable style-of-rendition icon is selected at this step S14 for the other note. After that, the style-of-rendition-icon pasting process loops back to step S6 in order to repeat the operations of steps S6–S14.

Further, if the style-of-rendition icon is to be modified to an even greater extent by application of a different kind of articulation, the style-of-rendition-icon pasting process proceeds to step S15 in order to select another style-of-rendition tab ("style tab" in the figure). Furthermore, in case the user desires to paste another style-of-rendition icon for another note, then another style-of-rendition tab is selected at step S15. After that, the style-of-rendition-icon pasting process loops back to step S4 in order to repeat the operations of steps S4 S15.

Moreover, if the user desires to paste a style-of-rendition-icon of another state for the same or other note as a result of the test-listening, the style-of-rendition-icon pasting process moves on to step S16 in order to select another state tab. For example, the "body" state is selected to replace the "attack" state. Then, the style-of-rendition-icon pasting process loops back to step S2 in order to repeat the operations of steps S2–S16. After completion of all necessary articulation setting for each selected state, the pasting process moves on to step S17. If the style-of-rendition-icon pasting process is not to be terminated as determined at step S17, the pasting process loops back to step S13 in order to repeat the operations of steps S13–S17, but if the style-of-rendition-icon pasting process is to be terminated, the pasting process exits from the series of operations without carrying out any further operations.

[Icon Modification (Editing) Process routine]

Figure 16:
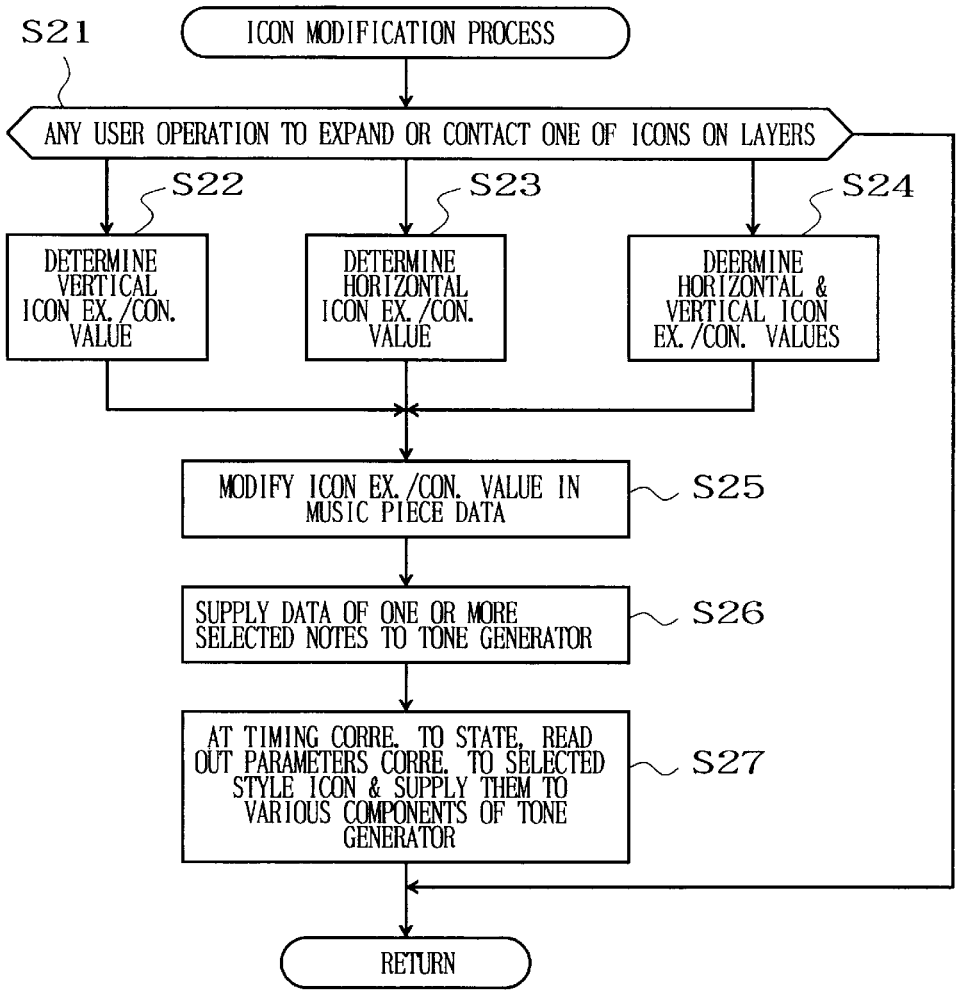
FIG. 16 is a flow chart showing an example of an icon modification (editing) process routine carried out in the style-of-rendition inputting apparatus of FIG. 1.

FIG. 16 is a flow chart showing an example of the icon modification (editing) process routine carried out in the style-of-rendition inputting apparatus in accordance with the preferred embodiment of the present invention. In this icon modification process routine, the depth and length (speed) of given articulation are modified by horizontally or vertically expanding/contracting the corresponding style-of-rendition icon pasted on any one of the layers of the displayed screen.

At first step S21, it is determined whether or not a user operation has been made to expand or contract any one of the style-of-rendition displayed on the layers (including the standard music notations in the "one layer plus traditional notation" display mode). If no such user operation has been made, the icon modification process routine is terminated immediately without performing any other operation. If, on the other hand, such a user operation has made as determined at step S21, then a specific type of the operation in question is identified. When the style-of-rendition icon is clicked on at its upper or lower end and dragged in the vertical direction by the user, the icon is expanded or contracted in the vertical direction, while when the style-of-rendition icon is clicked on at its left or right end and dragged in the horizontal direction by the user, the icon is expanded or contracted in the horizontal direction. Further, when the style-of-rendition icon is clicked on at one of its corners and dragged obliquely by the user, the icon is expanded or contracted simultaneously in both of the vertical and horizontal directions.

In the case where the user has made an operation to expand or contract the style-of-rendition icon in the vertical direction, the icon modification process routine goes to step S22 in order to determine an icon expansion/contraction value in the vertical direction. Similarly, in the case where the user has made an operation to expand or contract the style-of-rendition icon in the horizontal direction, the icon modification process routine goes to step S23 in order to determine an icon expansion/contraction value in the horizontal direction. Further, in the case where the user has made an operation to expand or contract the style-of-rendition icon in both the vertical and horizontal directions, the icon modification process routine goes to step S24 in order to determine icon expansion/contraction values in the vertical and horizontal directions.

Upon completion of the expansion/contraction value determining operation at any one of steps S22–S24, the icon modification process routine moves on to step S25 in order to modify an icon expansion/contraction value contained in the performance data, and then proceeds to steps S26 and S27. At step S26, one or more notes corresponding to the expansion/contraction-operated icon are selected so that data of the selected one or more notes are supplied to the tone generator section of FIG. 3, similarly to step S11. Then, at step S27, the style-of-rendition parameters of a particular bank determined by the note number(s) and velocity (velocities) are read out in corresponding relation to the selected style-of-rendition icon at timing corresponding to the state, the thus-readout parameters are supplied to the various processing blocks 43–45 and 46–48 of the tone generator section along with the icon expansion/contraction value, similarly to step S12.

It should be obvious here that the icon modification (editing) process routine of FIG. 16 can be carried out at any desired time other than during the course of the pasting process of FIG. 15. The style-of-rendition icons may be stored in memory as components of performance sequence data, as illustratively shown in FIG. 13, may be read out along with the performance data and visually shown on the display so that a desired one of the displayed style-of-rendition icons can be designated for editing purposes.

[Adaptation to Real-time Performance]

The foregoing description has been about the case where a desired style-of-rendition icon is selected using the mouse and the thus-selected style-of-rendition icon is edited for expansion or contraction. In an alternative, there may be provided an easy-to-operate icon changing switch so that an articulation-imparted performance corresponding to a real-time performance can be synthesized by entering information, representing the icon selection and editing, along with the original music-piece note data in real time. For example, during an automatic performance of a given music piece, a score of the music piece may be displayed to allow the user to designate a desired pasting location and then paste a desired style-of-rendition icon at the designated location in real time, or designate an already-pasted style-of-rendition icon and then edit the designated icon in real time. Such score display, designation etc. may be performed during a real-time performance rather than the automatic performance.

In summary, the present invention, as has been described so far, is characterized in that style-of-rendition icons, which are representative of articulation data to be imparted to original music-piece note data and capable of being shared among a plurality of musical instruments, are displayed in corresponding relation to a selected musical instrument while the original music-piece note data are displayed diagrammatically, selected ones of the style-of-rendition icons are pasted to the displayed original music-piece note data and instrument-by-instrument articulation data are imparted to the original music-piece note data in corresponding relation to the pasted icons to thereby generate performance data for the individual musical instruments. With such characteristic arrangements, desired articulation can be synthesized with high quality and improved efficiency by very simple operations of pre-registering various articulation styles in the form of icons and pasting the pre-registered icons on a musical score of the original music-piece note data visually shown on the display.

Because one style-of-rendition icon is shared, for identical or similar articulation, among a plurality of musical instruments, the present invention can substantially facilitate the user operation of the style-of-rendition icons to enter and set the articulation to the original music-piece note data and thereby achieve an improved operating efficiency. Further, even when one style-of-rendition icon common to a plurality of musical instruments is pasted, the present invention can impart articulation, unique to each of the musical instruments of individual parts, to the original music-piece note data in an actual performance, so that high-quality performance expression is achieved by the present invention. Furthermore, because the performance data corresponding to the pasted style-of-rendition icon are stored in memory using the icon-identifying data, i.e., the unique icon number, the necessary procedures for storing the performance data can be significantly simplified. In addition, because only the style-of-rendition icons representative of applicable articulation data are visually displayed in correspondence with the musical instrument of the part to which it is to be pasted—with any other icons than the style-of-rendition icons to be used for the musical instrument being not displayed at all—, it is possible to efficiently impart articulation suited for the musical instrument to be performed.

The present invention is also characterized in that a plurality of icon displaying layers are provided on the display in parallel relation to the original music-piece data display area, the style-of-rendition icons are classified in advance into groups representative of similar articulation styles (styles of rendition), and specific similar style-of-rendition icons are pasted to and displayed in each of the layers, in response to user selection of any one of the style-of-rendition icons on the basis of the classification. With such characteristic arrangements, the present invention allows the user to readily identify the current articulation settings.

The present invention is further characterized in that the original music-piece data display area and icon pasting areas (layers) are provided on the displayed screen and such articulation styles capable of being expressed by the traditional music notations are displayed along with the original music-piece data in the original music-piece data display area while articulation styles unique to the musical instrument to be performed are displayed as style-of-rendition icons in the icon pasting areas. With such characteristic arrangements, the present invention allows the user to readily identify and ascertain each articulation style being currently set.

Furthermore, by modifying the style-of-rendition icon pasted to the original music-piece data on the displayed screen and controlling the effectiveness or degree of articulation data to be imparted to the original music-piece data in accordance with the modification, interpolation can be readily made between respective sizes of the candidate icons. As a consequence, the degree of each articulation can be controlled finely and just as desired, which achieves high-quality articulation with increased efficiency.

Moreover, the icon modification according to the present invention can be made in a very simplified manner by using the mouse to modify the size of the icon in the horizontal or vertical direction. Thus, the articulation data can be adjusted in the time-axial direction by the horizontal modification of the style-of-rendition icon, and simultaneously the depth of the articulation data can be adjusted by the vertical modification of the style-of-rendition icon. As a result, the present invention can effectively control articulation characteristics to be imparted to the original music-piece data.

What is claimed is:

1. A style-of-rendition inputting apparatus comprising:

a display;

an operator device; and a processor operatively coupled with said display and said operator device, said processor being adapted to:

show a musical score of a given music piece on said display;

for a given style of rendition, present a plurality of different style-of-rendition icons that correspond to different degrees of rendition;

in response to an operation of said operator device, graphically select one of said plurality of style-of-rendition icons and designate a desired icon pasting location on the musical score; and show the selected graphical icon on said display in corresponding relation to the designated icon pasting location.

2. A style-of-rendition inputting apparatus as claimed in claim 1 wherein said processor is further adapted to impart style-of-rendition parameters, corresponding to each style-of-rendition icon pasted on the musical score, to original performance data corresponding to the musical score, whereby use of the style-of-rendition parameters allows a music performance to be executed in a style of rendition corresponding to the pasted style-of-rendition icon.

3. A style-of-rendition inputting apparatus as claimed in claim 2 wherein said style-of-rendition parameters are time-serial tone parameters obtained by analyzing a waveform of an actual performance tone of a musical instrument.

4. A style-of-rendition inputting apparatus as claimed in claim 1 wherein in order to place a desired style-of-rendition icon in a selectable condition in response to an operation of said operator device, said processor is further adapted to accept selection of a musical instrument and show, on said display, a set of available style-of-rendition icons for the selected musical instrument, whereby a user is allowed to select a desired one of the available style-of-rendition icons shown on said display.

5. A style-of-rendition inputting apparatus as claimed in claim 4 wherein said processor is adapted to show, on said display, a set of available articulation styles for the selected musical instrument, accepting selection of a user-desired articulation style from among the set of available articulation styles shown on said display and show, on said display, a set of style-of-rendition icons corresponding to the selected articulation style, to thereby place the style-of-rendition icons corresponding to the selected articulation style in a selectable condition.

6. A style-of-rendition inputting apparatus as claimed in claim 4 wherein some of the style-of-rendition icons can be shared between a plurality of different musical instruments, and wherein said processor is further adapted to control a music performance corresponding to the pasting location of the style-of-rendition icon in accordance with a combination of musical instrument selection information and style-of-rendition icon selection information.

7. A style-of-rendition inputting apparatus as claimed in claim 1 wherein the pasting location of the selected style-of-rendition icon can be designated with respect to a location of a desired note on the musical score.

8. A style-of-rendition inputting apparatus as claimed in claim 1 wherein the pasting location of the selected style-of-rendition icon can be designated within desired bounds on the musical score.

9. A style-of-rendition inputting apparatus as claimed in claim 1 wherein said processor is adapted to provide a sequence of performance data of the given music piece, and wherein pieces of information, each specifying a different one of the style-of-rendition icons pasted on the musical score, are contained in said sequence of performance data in corresponding relation to respective pasting locations of the style-of-rendition icons.

10. A style-of-rendition inputting apparatus as claimed in claim 9 which further comprises a storage that stores a performance sequence and the sequence of performance data is stored into said storage.

11. A style-of-rendition inputting apparatus as claimed in claim 1 wherein said processor is adapted to receive original performance data of the given music piece and add pieces of information, specifying the style-of-rendition icons pasted on the musical score, into a sequence of the received original performance data in corresponding relation to the respective pasting locations.

12. A style-of-rendition inputting apparatus as claimed in claim 1 which further comprises a tone generator mechanism, and wherein said processor is operatively coupled with said tone generator mechanism and is further adapted to cause said tone generator mechanism to generate a tone of a given note controlled in corresponding relation to a style-of-rendition icon pasted to a location of the given note on the musical score.

13. A style-of-rendition inputting apparatus as claimed in claim 1 wherein said processor is further adapted to generate style-of-rendition-controlling event information in corresponding relation to the style-of-rendition icon pasted to the desired icon pasting location on the musical score.

14. A style-of-rendition inputting apparatus as claimed in claim 1 wherein in order to place a desired style-of-rendition icon in a selectable condition in response to an operation of said operator device, said processor is adapted to designate a tonal articulation style corresponding to a time-dependent tone segment, connection between tones or a group of successive notes and show, on said display, a set of available style-of-rendition icons corresponding to the designated tonal articulation style, whereby a user is allowed to select a desired one of the available style-of-rendition icons shown on said display.

15. A style-of-rendition inputting apparatus as claimed in claim 1 which further comprises memory storing style-of-rendition parameters in corresponding relation to a plurality of the style-of-rendition icons, and wherein said processor is also operatively coupled with said memory and adapted to read out, from said memory, the style-of-rendition parameters corresponding to each of the style-of-rendition icons pasted on the musical score and set or control details of a music performance, corresponding to the pasting location of the style-of-rendition icon on the musical score, in accordance with the style-of-rendition parameters read out from said memory.

16. A style-of-rendition inputting apparatus as claimed in claim 1 which further comprises a tone generator mechanism, and wherein said processor is operatively coupled with said tone generator mechanism and is further adapted to cause said tone generator mechanism to generate a performance tone of the given music piece, and wherein said processor is adapted to show the musical score, via said display, during a performance of the music piece and paste a desired style-of-rendition icon to a desired location on the musical score in real time during the performance.

17. A style of rendition inputting apparatus as claimed in claim 1, wherein said processor is further adapted to display a first graphical menu for selecting articulation states, said first graphical menu having a plurality of graphical tabs that correspond to a plurality of articulation states, and a second graphical menu for selecting styles of rendition, said second graphical menu having a plurality of graphical tabs that correspond to a plurality of types of styles of rendition, and wherein said second graphical menu is displayed in a hierarchical relationship to the first graphical menu, and wherein said plurality of different style-of-rendition icons are presented upon the designation of a tab on the second graphical menu that correspond with said given style of rendition.

18. A style-of-rendition inputting apparatus as claimed in claim 1 wherein the dimensions of the graphical symbol for each style-of-rendition icon correspond the degree of rendition of the given style-of-rendition.

19. A method of inputting a style of rendition comprising the steps of:

showing a musical score of a given music piece on a display;

for a given style of rendition, showing a plurality of style-of-rendition icons that correspond to different degrees of rendition;

graphically selecting a desired style-of-rendition icon from among said plurality of style-of-rendition icons and designating a desired icon pasting location on the musical score; and showing the selected style-of-rendition icon on said display in corresponding relation to the designated icon pasting location.

20. The method of claim 19, further comprising the step of:

displaying a first graphical menu for selecting articulation states, said first graphical menu having a plurality of graphical tabs that correspond to a plurality of articulation states;

displaying a second graphical menu for selecting styles of rendition, said second graphical menu having a plurality of graphical tabs that correspond to a plurality of types of styles of rendition, wherein said second graphical menu is displayed in a hierarchical relationship to the first graphical menu; and presenting said plurality of different style-of-rendition icons upon the designation of a tab on the second graphical menu that correspond with said given style of rendition.

21. The method of claim 19, wherein the dimensions of the graphical symbol for each style-of-rendition icon correspond to the degree of rendition of the given style-of-rendition.

22. A machine-readable storage medium containing a group of instructions of a style-of-rendition inputting program executable by a processor, said processor being operatively coupled with a display and an operator device, said program causing the processor to performing a method comprising the steps of:

showing a musical score of a given music piece on said display;

for a given style of rendition, showing a plurality of style-of-rendition icons that correspond to different degrees of rendition;

in response to an operation of said operator device, graphically selecting a desired style-of-rendition icon from among said plurality of style-of-rendition icons and designating a desired icon pasting location on the musical score; and showing the selected style-of-rendition icon on said display in corresponding relation to the designated icon pasting location.

23. A machine-readable storage medium as claimed in claim 22, wherein said method further comprises a step of imparting style-of-rendition parameters, corresponding to each style-of-rendition icon pasted on the musical score, to original performance data corresponding to the musical score, whereby use of the style-of-rendition parameters allows a music performance to be executed in a style of rendition corresponding to the pasted style-of-rendition icon.

24. A machine-readable storage medium as claimed in claim 22, where said method further comprises a step of providing a sequence of performance data of the given music piece, and wherein of information, each specifying a different one of the stile-of-rendition icons pasted on the musical score, are contained in said sequence of performance data in corresponding relation to respective pasting locations of the style-of-rendition icons.

25. A machine-readable storage medium as claimed in claim 22, wherein said method further comprises a step of causing said tone generator mechanism to generate a tone of give note controlled in corresponding relation to a style-of-rendition icon pasted to a location of the given note on the musical score.

26. The machine-readable storage medium of claim 22, wherein said method further comprises the steps of:

displaying a first graphical menu for selecting articulation states, said first graphical menu having a plurality of graphical tabs that correspond to a plurality of articulation states;

displaying a second graphical menu for selecting styles of rendition, said second graphical menu having a plurality of graphical tabs that correspond to a plurality of types of styles of rendition, wherein said second graphical menu is displayed in a hierarchical relationship to the first graphical menu; and presenting said plurality of different style-of-rendition icons upon the designation of a tab on the second graphical menu that correspond with said given style of rendition.

27. The machine-readable storage medium of claim 22, wherein the dimensions of the graphical symbol for each style-of-rendition icon correspond to the degree of rendition of the given style-of-rendition.

28. An electronic music apparatus comprising:

a display;

an operator device; and a processor operatively coupled with said display and said operator device, said processor being adapted to:

show a musical score of a given music piece on said display;

for a given style of rendition, show a plurality of style-of-rendition icons that correspond to different degrees of rendition;

in response to an operation of said operator device, graphically select from a style-of-rendition icon from said plurality of style-of-rendition icons and designate a desired icon pasting location on the musical score;

show the selected style-of-rendition icon on said display in corresponding relation to the designated icon pasting location; and control a music performance corresponding to the musical score in accordance with style-of-rendition parameters corresponding to the style-of-rendition icon pasted to each icon pasting location on the musical score.

29. An electronic music apparatus as claimed in claim 28 wherein said processor is further adapted to, in response to an operation of said operator device, designate the style-of-rendition icon pasted on the musical score shown on said display and then edit contents of style-of-rendition information corresponding to the designated style-of-rendition icon.

30. An electronic music apparatus as claimed in claim 29 wherein said CT processor is adapted to edit the style-of-rendition information corresponding to the designated style-of-rendition icon by modifying a figure of the designated style-of-rendition icon.

31. An electronic music apparatus as claimed in claim 28, wherein said processor is further adapted to display a first graphical menu for selecting articulation states, said first graphical menu having a plurality of graphical tabs that correspond to a plurality of articulation states, and a second graphical menu for selecting styles of rendition, said second graphical menu having a plurality of graphical tabs that correspond to a plurality of types of styles of rendition, and wherein said second graphical menu is displayed in a hierarchical relationship to the first graphical menu, and wherein said plurality of different style-of-rendition icons are presented upon the designation of a tab on the second graphical menu that correspond with said given style of rendition.

32. An electronic music apparatus as claimed in claim 28, wherein the dimensions of the graphical symbol for each style-of-rendition icon correspond to the degree of rendition of the given style-of-rendition.

33. A style-of-rendition inputting apparatus comprising:

a display;

an operator device; and a processor operatively coupled with said display and said operator device, said processor being adapted to:

show a musical score of a given music piece on said display;

display a style-of-rendition notation window in parallel relation to the shown musical score;

display a plurality of style-of-rendition icons, said plurality of style-of-rendition icons being displayed outside of said window;

in response to an operation of said operator device, graphically select a desired style-of-rendition icon and designate a desired icon pasting location on the musical score; and show the selected style-of-rendition icon within said window in a vertically corresponding relation to the designated icon pasting location on the musical score.

34. A style-of-rendition inputting apparatus as claimed in claim 33 wherein said processor is adapted to set a plurality rows of the style-of-rendition notation windows in parallel relation to the musical score display area on said display, whereby when a plurality of different style-of-rendition icons are to be pasted to a same location on the musical score, the style-of-rendition icons can be shown in separate respective ones of the style-of-rendition notation windows.

35. A style-of-rendition inputting apparatus as claimed in claim 33 wherein said processor is adapted to set a plurality rows of the style-of-rendition notation windows in parallel relation to the musical score display area on said display, each row of the style-of-rendition notation window is designated for a particular style of rendition group, and the selected style-of-rendition icon is shown in the row of style-of-rendition notation window that corresponds to the style-of-rendition group to which the selected style-of-rendition icon belong.

36. A style-of-rendition inputting apparatus as claimed in claim 33 wherein the style-of-rendition notation windows are associated with a predetermined type of style-of-rendition icon group, and wherein when the selected style-of-rendition icon belongs to the predetermined type, said processor is adapted to cause the selected style-of-rendition icon to be shown in the style-of-rendition window of said display in corresponding relation to the designated icon pasting location, but when the selected style-of-rendition icon does not belong to the predetermined type, said processor is adapted to cause the selected style-of-rendition icon to be additionally shown in the musical score display area on said display in a vertically corresponding relation to the designated icon pasting location.

37. A style-of-rendition inputting apparatus as claimed in claim 25, wherein said plurality of style-of-rendition icons correspond to different degrees of rendition for a given style of rendition.

38. A method of inputting a style of rendition comprising the steps of:

showing a musical score of a given music piece on a display;

display a style-of-rendition notation window in parallel relation to the shown musical score;

display a plurality of style-of-rendition icons, said plurality of style-of-rendition icons being displayed outside of said window;

graphically selecting a desired style-of-rendition icon and designating a desired icon pasting location on the musical score; and showing the selected style-of-rendition icon within said window in a vertically corresponding relation to the designated icon pasting location on the musical score.

39. A machine-readable storage medium containing a group of instructions of a style-of-rendition inputting program executable by a processor, said processor being operatively coupled with a display and an operator device, said program causing the processor the perform the steps of:

showing a musical score of a given music piece on said display;

display a style-of-rendition notation window in parallel relation to the shown musical score;

display a plurality of style-of-rendition icons, said plurality of style-of-rendition icons being displayed outside of said window:

in response to an operation of said operator device, graphically selecting a desired style-of-rendition icon and designating a desired icon pasting location on the musical score; and showing the selected style-of-rendition icon within said window in a vertically corresponding relation to the designated icon pasting location on the musical score.

40. A style-of-rendition inputting apparatus comprising:

a display;

an operator device; and a processor operatively coupled with said display and said operator device, said processor being adapted to:

show a musical score of a given music piece on said display;

for a given style of rendition, show a plurality of style-of-rendition icons that correspond to different degrees of rendition;

cause a selected style-of-rendition icon to be graphically pasted to and shown at a given performance location on the musical score shown on said display; and use said operator device to graphically designate the style-of-rendition icon pasted to the given performance location on the musical, score in order to edit style-of-rendition information corresponding to the designated style-of-rendition icon.

41. A style-of-rendition inputting apparatus as claimed in claim 40 wherein the style-of-rendition information comprises time-serial tone parameters obtained by analyzing a waveform of an actual performance tone of a musical instrument corresponding to a style of rendition represented by the style-of-rendition information.

42. A style-of-rendition inputting apparatus as claimed in claim 40 which further comprises a tone generator mechanism, and wherein said processor is operatively coupled with said tone generator mechanism and is further adapted to, before or after editing of the style-of-rendition information, cause said tone generator mechanism to generate a tone of a note on the musical score controlled in corresponding relation to the designated style-of-rendition icon.

43. A style-of-rendition inputting apparatus as claimed in claim 40 which further comprises a tone generator mechanism, wherein said processor is operatively coupled with said tone generator mechanism and is further adapted to cause said tone generator mechanism to generate a performance tone of the given musical score, and wherein said processor is adapted to show the musical score, via said display, during a performance of the music piece and designate a desired style-of-rendition icon in real time during the performance to edit the desired style-of-rendition icon.

44. The style-of-rendition inputting apparatus of claim 40, wherein said processor is further adapted to display a first graphical menu for selecting articulation states, said first graphical menu having a plurality of graphical tabs that correspond to a plurality of articulation states, and a second graphical menu for selecting styles of rendition, said second graphical menu having a plurality of graphical tabs that correspond to a plurality of types of styles of rendition, and wherein said second graphical menu is displayed in a hierarchical relationship to the first graphical menu, and wherein said plurality of different style-of-rendition icons are presented upon the designation of a tab on the second graphical menu that correspond with said given style of rendition.

45. The style-of-rendition inputting apparatus of claim 40, wherein the dimensions of the graphical symbol for each style-of-rendition icon correspond to the degree of rendition of the given style-of-rendition.

46. A style-of-rendition inputting apparatus comprising:

a display;

an operator device: and a processor operatively coupled with said display and said operator device, said processor being adapted to:

show a musical score of a given music piece on said display:

cause a given style-of-rendition icon to be pasted to and shown at a given performance location on the musical score shown on said display and use said operator device to graphically designate the style-of-rendition icon pasted to the given performance location on the musical score in order to edit style-of-rendition information corresponding to the designated style-of-rendition icon, wherein said processor edits the style-of-rendition information by modifying a figure of the style-of-rendition icon pasted on the musical score shown on said display so as to modify at least one predetermined factor of the style-of-rendition information corresponding to the icon.

47. A style-of-rendition inputting apparatus as claimed in claim 46 wherein said at least one predetermined factor of the style-of-rendition information corresponding to the style-of-rendition is modified by expanding or contracting the figure of the style-of-rendition icon at least along one direction.

48. A style-of-rendition inputting apparatus as claimed in claim 46 wherein the figure of the style-of-rendition icon can be modified to be expanded or contracted along either one of two different directions or both of the two different directions simultaneously, and a different factor of the style-of-rendition information is modified depending on along which of the two different directions the figure of the style-of-rendition icon has been modified.

49. A style-of-rendition inputting apparatus as claimed in claim 46 wherein a time factor of the style-of-rendition information corresponding to the style-of-rendition icon is modified by expanding or contracting the figure of the style-of-rendition icon along a time-axial direction of the musical score.

50. A style-of-rendition inputting apparatus as claimed in claim 46 where in a magnitude or depth of the style-of-rendition information corresponding to the style-of-rendition icon is modified by expanding or contracting the figure of the style-of-rendition icon along a direction different from the time-axial direction of the musical score.

51. A method of inputting a style of rendition comprising the the step of:

showing a musical score of a given music piece on a display;

displaying a plurality of different styles-of-rendition icons for a particular given style of rendition, where each of said different styles-of-rendition icons corresponds to a different degree of rendition;

causing a given style-of-rendition icon to be graphically pasted to and shown at a given performance location on the musical score shown on said display; and graphically designating the style-of-rendition icon pasted to the given performance location on the musical, score style-of-rendition information corresponding to the designated style-of-rendition icon.

52. The method of claim 51, further comprising the steps of:

displaying a first graphical menu for selecting articulation states, said first graphical menu having a plurality of graphical tabs that correspond to a plurality of articulation states;

displaying a second graphical menu for selecting styles of rendition, said second graphical menu having a plurality of graphical tabs that correspond to a plurality of types of styles of rendition, wherein said second graphical menu is displayed in a hierarchical relationship to the first graphical menu; and presenting said plurality of different style-of-rendition icons upon the designation of a tab on the second graphical menu that correspond with said given style of rendition.

53. The method of claim 51, wherein the dimensions of the graphical symbol for each style-of-rendition icon correspond to the degree of rendition of the given style-of-rendition.

54. A machine-readable storage medium containing a group of instructions of a style-of-rendition inputting program executable by a processor, said processor being operatively coupled with a display and an operator device, said program causing the processor to perform a method comprising the steps of:

showing a musical score of a given music piece on said display;

displaying a plurality of different styles-of-rendition icons for a particular given style of rendition, wherein each of said different styles-of-rendition icons corresponds to a different degree of rendition;

causing a given style-of-rendition icon to be graphically pasted to and shown at a given performance location on the musical score shown on said display; and graphically designating the style-of-rendition icon pasted to the given performance location on the musical, score in order to edit style-of-rendition information corresponding to the designated style-of-rendition icon.

55. The machine-readable storage medium of claim 54, wherein said method further comprises the steps of:

displaying a first graphical menu for selecting articulation states, said first graphical menu having a plurality of graphical tabs that correspond to a plurality of articulation states;

displaying a second graphical menu for selecting styles of rendition, said second graphical menu having a plurality of graphical tabs that correspond to a plurality of types of styles of rendition, wherein said second graphical menu is displayed in a hierarchical relationship to the first graphical menu; and presenting said plurality of different style-of-rendition icons upon the designation of a tab on the second graphical menu that correspond with said given style of rendition.

56. The machine-readable storage medium of claim 54, wherein the dimensions of the graphical symbol for each style-of-rendition icon correspond to the degree of rendition of the given style-of-rendition.

57. A style-of-rendition displaying apparatus comprising:

a display;

a storage that stores data of a plurality of style-of-rendition icons, wherein at least two of said plurality of style-of-rendition icons correspond to different degrees of rendition for a given style of rendition; and a processor operatively coupled with said display and said storage, said processor adapted to:

display a musical score of a given music piece on said display display said plurality of style-of-rendition icons;

read out data of a designated style-of-rendition icon from said storage; and graphically paste the designated style-of-rendition icon at a given performance location on said musical score.

58. A style-of-rendition displaying apparatus as claimed in claim 42 which further comprises an operator device, wherein said processor is operatively coupled with said operator device and is further adapted to, in response to the use of said operator device. designate the style-of-rendition icon pasted to the given performance location on the musical score in order to edit the data corresponding to the designated style-of-rendition icon.

59. A style-of-rendition display apparatus of claim 57, wherein said processor is further adapted to display a first graphical menu for selecting articulation states, said first graphical menu having a plurality of graphical tabs that correspond to a plurality of articulation states, and a second graphical menu for selecting styles of rendition, said second graphical menu having a plurality of graphical tabs that correspond to a plurality of types of styles of rendition, and wherein said second graphical menu is displayed in a hierarchical relationship to the first graphical menu, and wherein said plurality of different style-of-rendition icons are presented upon the designation of a tab on the second graphical menu that correspond with said given style of rendition.

60. The style-of-rendition display apparatus of claim 57, wherein the dimensions of the graphical symbol for each style-of-rendition icon correspond to the degree of rendition of the given style-of-rendition.

61. A method of inputting a style of rendition comprising the steps of:

displaying a musical score of a given music piece on a display;

causing a given style-of-rendition icon to be graphically pasted to and shown at a given performance location on the musical score shown on said display; and graphically designate the style-of-rendition icon pasted to the given performance location on the musical score, editing the style-of-rendition information by modifying a figure of the style-of-rendition icon pasted on the musical score shown on said display so as to modify at least one predetermined factor of the style-of-rendition information corresponding to the modified style-of-rendition.

62. A machine-readable storage medium containing a group of instructions of a style-of-rendition inputting program executable by a processor, said processor being operatively coupled with a display and an operator device, said program causing the processor to perform a method comprising the steps of:

displaying a musical score of a given music piece on said display;

causing a given style-of-rendition icon to be graphically pasted to and shown at a given performance location on the musical score shown on said display; and graphically designate the style-of-rendition icon pasted to the given performance location on the musical score, editing the style-of-rendition information by modifying a figure of the style-of-rendition icon pasted on the musical score shown on said display so as to modify at least one predetermined factor of the style-of-rendition information corresponding to the modified style-of-rendition.

* * * * *